US009120611B2

(12) United States Patent
Ziegs

(10) Patent No.: US 9,120,611 B2
(45) Date of Patent: Sep. 1, 2015

(54) FLEXIBLE FLUID STORAGE TANK

(71) Applicant: Dustin Ziegs, Grand Junction, CO (US)

(72) Inventor: Dustin Ziegs, Grand Junction, CO (US)

( * ) Notice: Subject to any disclaimer, the term of this patent is extended or adjusted under 35 U.S.C. 154(b) by 0 days.

(21) Appl. No.: 14/016,049

(22) Filed: Aug. 31, 2013

(65) Prior Publication Data

US 2014/0061204 A1 Mar. 6, 2014

Related U.S. Application Data

(60) Provisional application No. 61/696,141, filed on Sep. 1, 2012, provisional application No. 61/731,311, filed on Nov. 29, 2012, provisional application No. 61/843,000, filed on Jul. 4, 2013.

(51) Int. Cl.

| | |
|---|---|
| ***B65D 88/36*** | (2006.01) |
| ***B65D 88/02*** | (2006.01) |
| ***B65D 88/52*** | (2006.01) |
| ***B65D 90/02*** | (2006.01) |
| ***B65D 90/08*** | (2006.01) |

(52) U.S. Cl.

CPC ..... *B65D 88/02* (2013.01); *B65D 88/36* (2013.01); *B65D 88/522* (2013.01); *B65D 88/528* (2013.01); *B65D 90/023* (2013.01); *B65D 90/028* (2013.01); *B65D 90/08* (2013.01); *Y10T 29/49* (2015.01)

(58) Field of Classification Search

CPC ..... B65D 88/02; B65D 88/36; B65D 88/522; B65D 90/023; B65D 90/08; B65D 88/528; Y10T 29/49

USPC ..... 220/4.12, 4.16, 4.08, 4.28, 666, 565, 220/567, 567.1, 567.2, 567.3, 626; 206/386, 600

See application file for complete search history.

(56) References Cited

U.S. PATENT DOCUMENTS

| | | | | |
|---|---|---|---|---|
| 2,954,896 | A * | 10/1960 | Russell et al. | 220/320 |
| 3,781,942 | A * | 1/1974 | Coleman | 15/246.5 |
| 3,784,043 | A * | 1/1974 | Presnick | 220/4.28 |
| 4,114,668 | A * | 9/1978 | Hickey | 220/232 |
| 4,506,798 | A * | 3/1985 | Goutille | 220/1.5 |
| 5,713,649 | A * | 2/1998 | Swift | 312/257.1 |
| 5,820,718 | A | 10/1998 | Dean | |
| 6,161,719 | A | 12/2000 | Madison | |
| 6,216,900 | B1 | 4/2001 | Bonerb et al. | |
| 6,648,159 | B2 * | 11/2003 | Prutkin et al. | 220/4.28 |
| 2010/0045017 | A1 | 2/2010 | Rea | |
| 2010/0320201 | A1 | 12/2010 | Dagesse | |

* cited by examiner

*Primary Examiner* — Robert J Hicks
*Assistant Examiner* — Kareen Rush
(74) *Attorney, Agent, or Firm* — Luis Figarella

(57) ABSTRACT

A flexible fluid storage tank and method for assembling, with specific emphasis on a system that may be field assembled with little or no tools, while preserving the flexibility of being tailored in size, shape and configuration to the user's needs with minimal customization and disassembly capabilities.

12 Claims, 27 Drawing Sheets

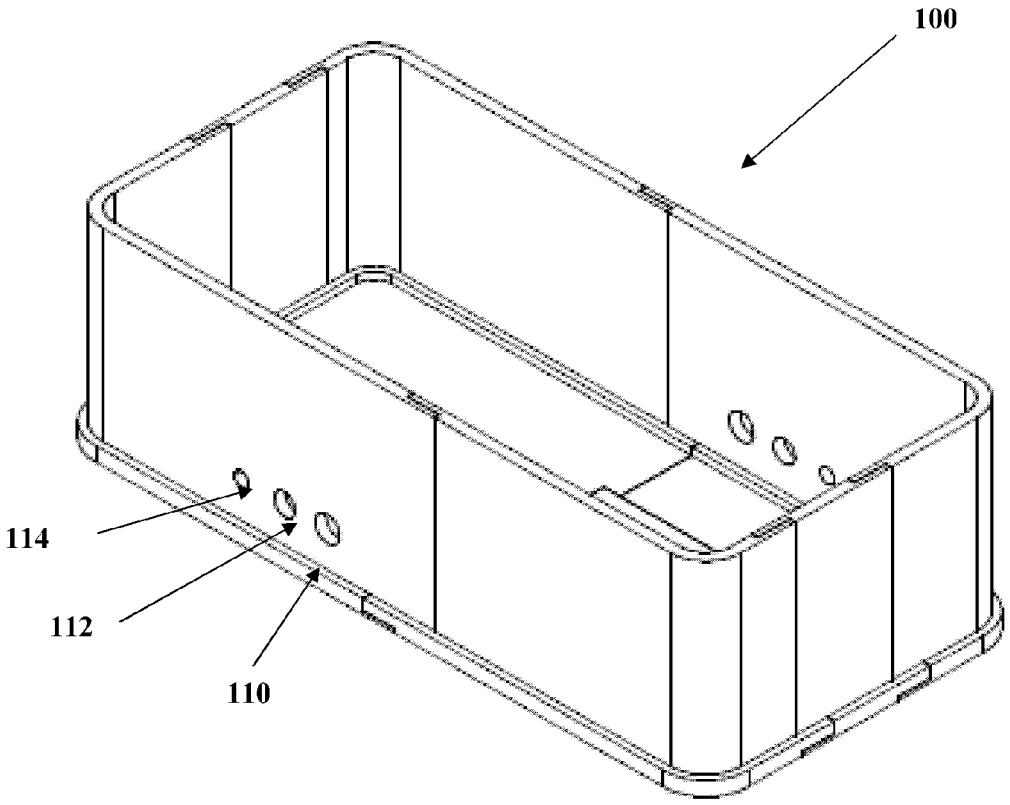
Fig. 1A
Fig. 1B
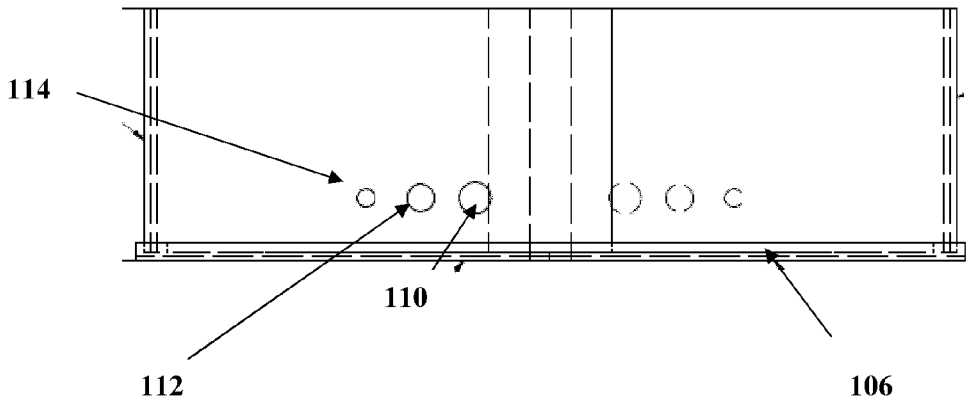

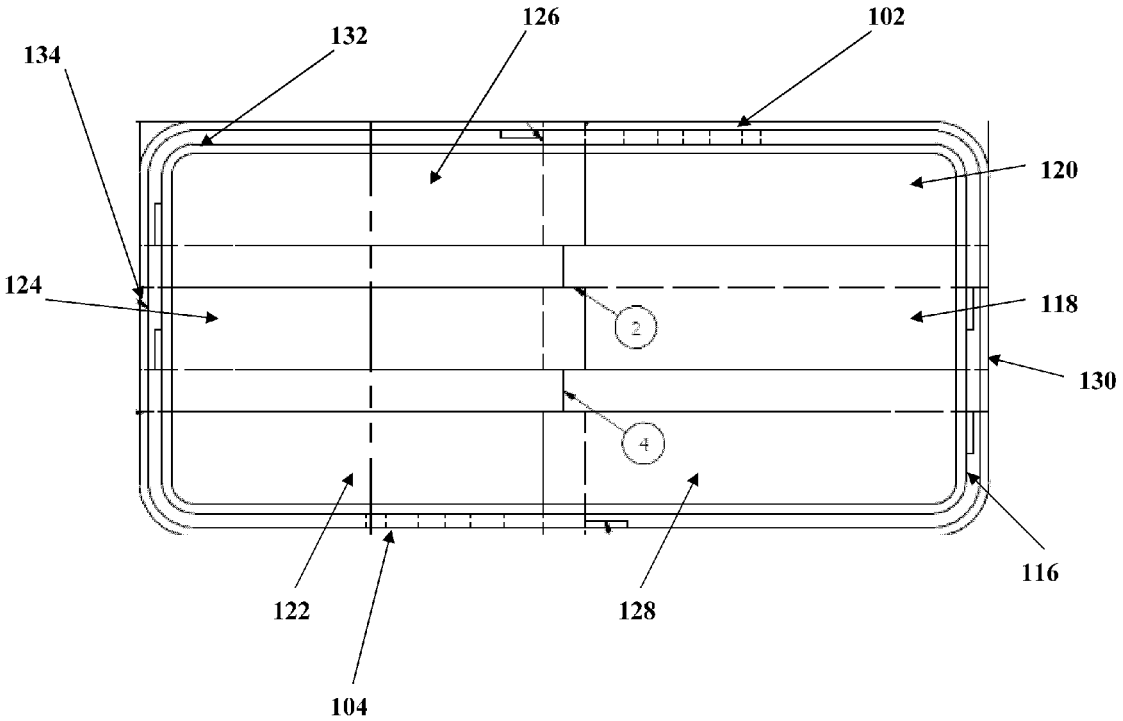
Fig. 1C
Fig. 1D
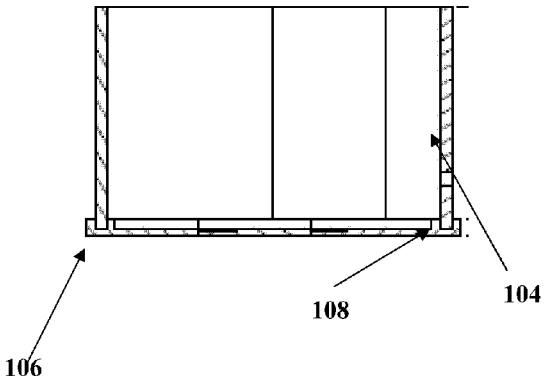
Fig. 1E
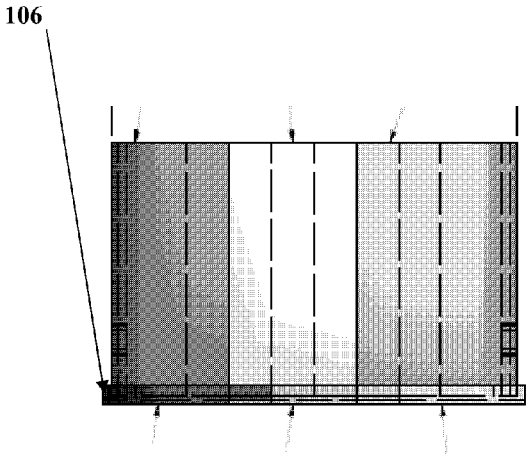

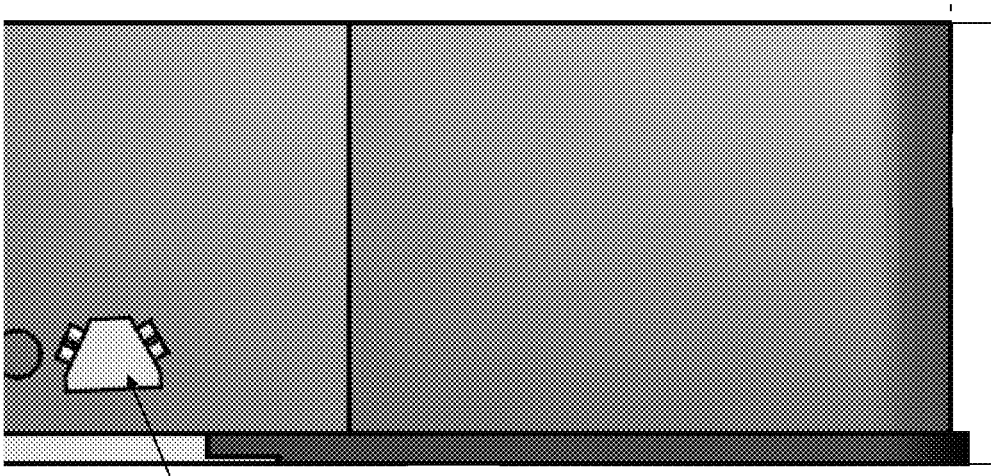
Fig. 11
1202
Fig. 12
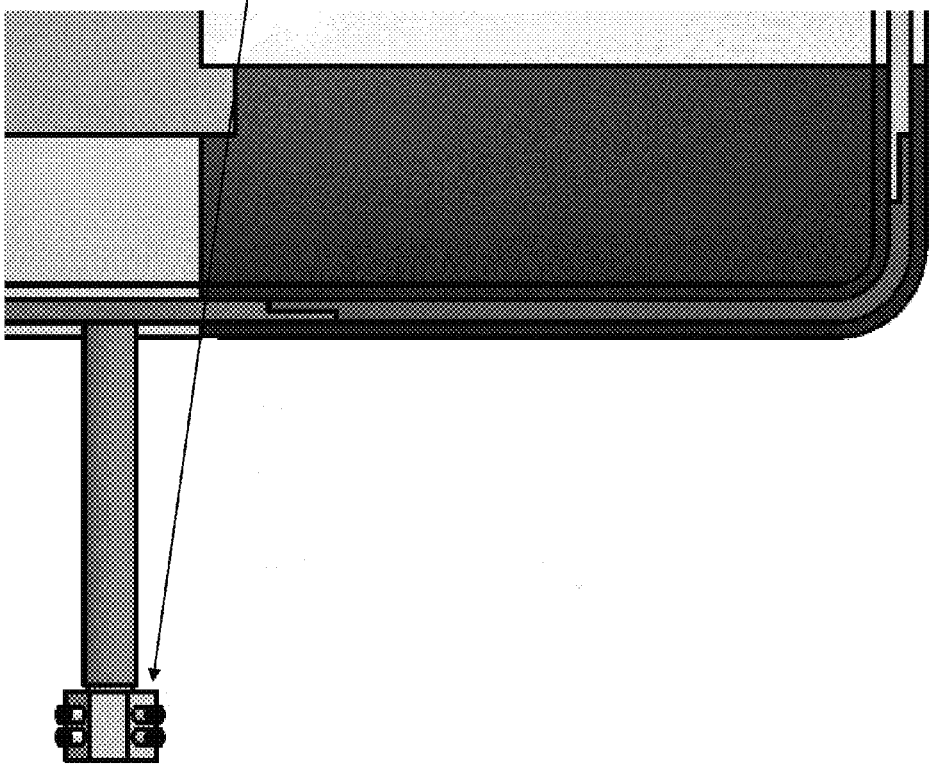

1202

FLEXIBLE FLUID STORAGE TANK

CROSS-REFERENCE TO RELATED APPLICATIONS

This application claims priority to U.S. Provisional patent application Ser. No. 61/696,141 titled "Fluid Storage Tank", filed on Sep. 1, 2012, U.S. Provisional patent application Ser. No. 61/731,311 titled "Flexible Fluid Storage Tank", filed on Nov. 29, 2012, and U.S. Provisional patent application Ser. No. 61/843,000 titled "Flexible Fluid Storage Tank", filed on Jul. 4, 2013, the disclosures of each of which are herein incorporated by reference in their entireties.

PATENTS CITED

The following documents and references are incorporated by reference in their entirety, Dean (U.S. Pat. No. 5,820,718), Madison (U.S. Pat. No. 6,161,719), Bonerb et al (U.S. Pat. No. 6,216,900), Rea (US Pat. Pub. No. 2010/00045017, Dagesse (US Pat. Pub. No. 2010/0320201).

FIELD OF THE INVENTION

The present invention relates to fluid storage tanks. More particularly, the present invention relates to an apparatus, system and method for assembling and using such fluid storage tanks. Additionally, the present invention relates to system, methods and apparatus for deploying tanks that are expandable in the field.

DESCRIPTION OF THE RELATED ART

Fluid storage tanks, such as those used on field applications including drilling, agriculture and other such applications must have high strength requirements, mainly due to the weight of the fluid stored in the tanks, but also because of the ground they are usually placed on. This dictates that in many cases, these tanks be built of monolithic assemblies that are either welded, screwed or use fixed dimensions liners.

Many fluid storage tanks have been developed with side, bottom and top pieces welded together to form the tank. Others have bolted members. Others have a liner placed inside, avoiding the need for precise joining of the welds. A traditional technique for forming such liquid storage tanks is shown in T. S. Dean (U.S. Pat. No. 5,820,718). As shown in that patent, the floor of the tank is placed on a support surface and the sides and ends are welded internally to the floor.

A lid is then placed onto the opposite ends of the sides and ends and is welded to the sides and the ends by placing the lid a small distance below an upper edge of the sides and ends. In this manner, a single external weld is applied between the lid and the sides and ends. In this traditional technique of forming liquid storage tanks, it is only possible to apply a single external weld between the lid and the sides and the ends.

In contrast, there is a need within certain industries (e.g. gas and oil drilling, particularly for fracking) for a flexible fluid tank that may be quickly assembled in situ with light or no tools.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect the invention is about a fluid storage tank apparatus comprising a tank base comprised of one or more floor panels, said panels having one or more floor interlocking and sealing means, tank walls comprised of two or more tank walls, each said tank wall having one or more matching sets of wall interlocking and sealing means and base-wall interface sealing means at or near the periphery of said tank base. In another aspect one or more seal interface mechanical pressure fittings along said floor panels or said wall panels joints. In yet another aspect one or more said floor or wall interlocking means are comprised of one or more pin and hooks arrangements. In one aspect said pin is tear shaped. In another aspect one or more said floor or wall sealing means are comprised of at least one element selected from the group comprised by a gasket, O-ring, silicon weld, rhino-liner or other suitable seal; and said base-wall interface sealing means are comprised of at least one element selected from the group comprised by a continuous base channel or one or more gaskets around its inner perimeter where said base interfaces with said wall's base. In one aspect one or more top panels are floated atop the liquid in said tank.

In another aspect, the invention is about a method of making a fluid storage tank apparatus comprising providing a tank base comprised of one or more floor panels, said panels having one or more floor interlocking and sealing means, providing tank walls comprised of two or more tank walls, each said tank wall having one or more matching sets of wall interlocking and sealing means and providing base-wall interface sealing means at or near the periphery of said tank base. In another aspect about a method providing one or more seal interface mechanical pressure fittings along said floor panels or said wall panels joints. In yet another aspect about a method providing one or more said floor or wall interlocking means comprised of one or more pin and hooks arrangements. In one aspect about a method providing one or more tear shaped pin. In one aspect about a method providing one or more said floor or wall sealing means comprised of at least one element selected from the group comprised by a gasket, O-ring, silicon weld, rhino-liner or other suitable seal and providing said base-wall interface sealing means comprised of at least one element selected from the group comprised by a continuous base channel or one or more gaskets around its inner perimeter where said base interfaces with said wall's base. In another aspect about a method providing one or more top panels are floated atop the liquid in said tank. In yet another aspect about a method providing one or more said floor or wall interlocking means comprised of one or more pin and hooks arrangements.

Other features and advantages of the present invention will become apparent upon examining the following detailed description of an embodiment thereof, taken in conjunction with the attached drawings.

BRIEF DESCRIPTION OF THE DRAWINGS

FIGS. 1A-1E show various views of a proposed flexible fluid tank, according to exemplary embodiments.

FIGS. 11-14 show various views a proposed flexible fluid tank, according to an exemplary embodiment.

Figure 2A:
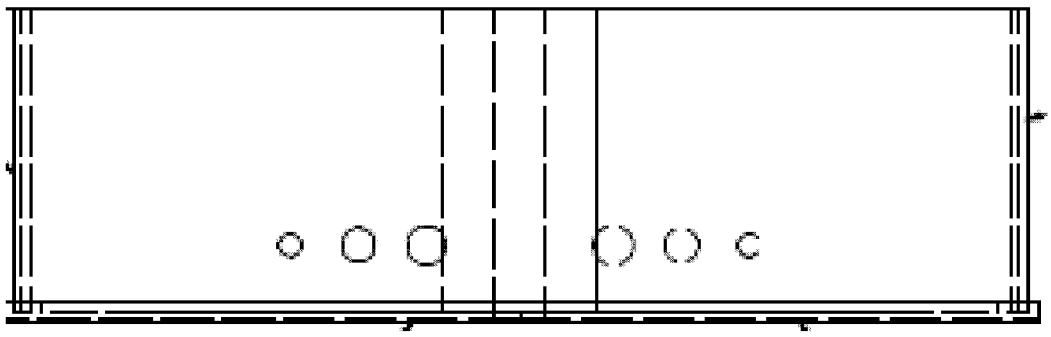
FIGS. 2A-2B shows a side and isometric view of a proposed flexible fluid tank, according to exemplary embodiments.

The above-described and other features will be appreciated and understood by those skilled in the art from the following detailed description, drawings, and appended claims.

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein; this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Referring to FIGS. 1A-1E we see one proposed embodiment of the invention 100. In one embodiment, the flexible fluid tank is formed by a combination of two or more sides or wall panels (102, 104) and a base 106. While a rectangular shaped tank is shown, the tank may be round, elliptical, square or of any other suitable shape. Such a tank has a number of advantages; it is liner-less (although one may be fitted if desired), it is mobile, faster to set up, ports may be fitted in either the sides or the bottom, the actual capacity (as well as size) of the tank may be grown or shrunk via the addition of panels and the tank may have an optional lid.

When referring to fluids, we refer to the group comprised by such liquids as water and others, including their use for FRAC or fracturing drilling water and associated liquids. The terms fluid and liquid may be interchangeably used in this specification. An advantage of having a tank like this be a liner less is that you won't have to pay for a liner every time the tank is set up, or for the disposal of such liner after its (frequent) one time use.

Referring to FIG. 1D, we see how the tank sides or walls (102, 104) bottom's fit into a channel 108 built around the periphery of the tank's base 106. In one embodiment, both the walls and/or the bottoms of the channel 108 have gaskets or other suitable fluid sealing means within them, in order to prevent the fluid from seeping out from the tank inside (or vice versa).

In an alternate embodiment, one or more of the floor or base 106 portions may be equipped with drain openings. Such a liner-less tank allows the hydration units to pull water from the tanks without the use of a candy cane suction line and to use their own pumps instead of a separate tank supply pump. Use of a non-collapsible tank like this also makes it potentially safer and easier to set up and move around.

The base 106 of the tank may be comprised of one or more base or floor panels (116, 118, 120, 122, 124, 126), designed to be shaped in an interlocking form and inter-joined through weight as well as through a tear shaped or otherwise suitable shaped pin 806 that are designed to be inserted into loops, hooks or nubs 310 or other mechanically attached extensions of one panel, so that they are designed to keep the joints under pressure.

In one embodiment, said pressure is generated by the tear shape of portions of the pin 806, so that when the pin 806 is rotated, the pressure on the hook or nub 310 presses both panels together against each other and/or the optional sealing means of a gasket, O-ring, silicone weld, rhino liner or seal 308. In an alternate embodiment, the same may be accomplished using screws and matching nuts, press pliers, etc. In such a way, the tank may be assembled, disassembled, stored, transported and re-used. In such a fashion, the tank becomes both reusable and may be assembled/disassembled as required. The walls may themselves be comprised of two or more portions, wall or side panels (102, 104, 128, 130, 132, 134), also designed to be joined through pin/hooks.

Figure 2B:
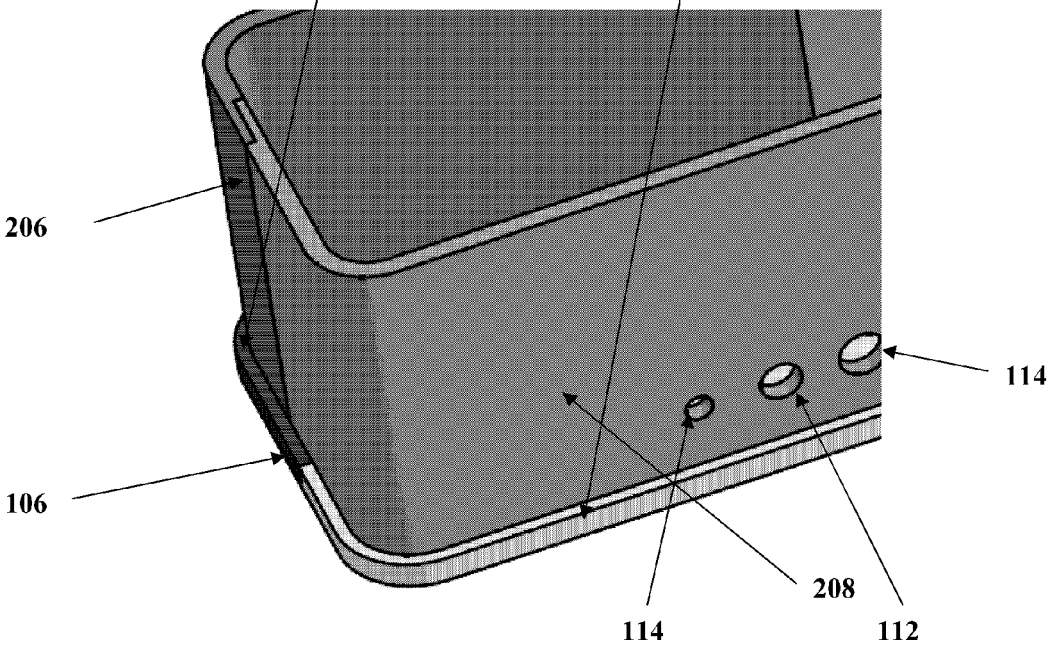
Figure 3:
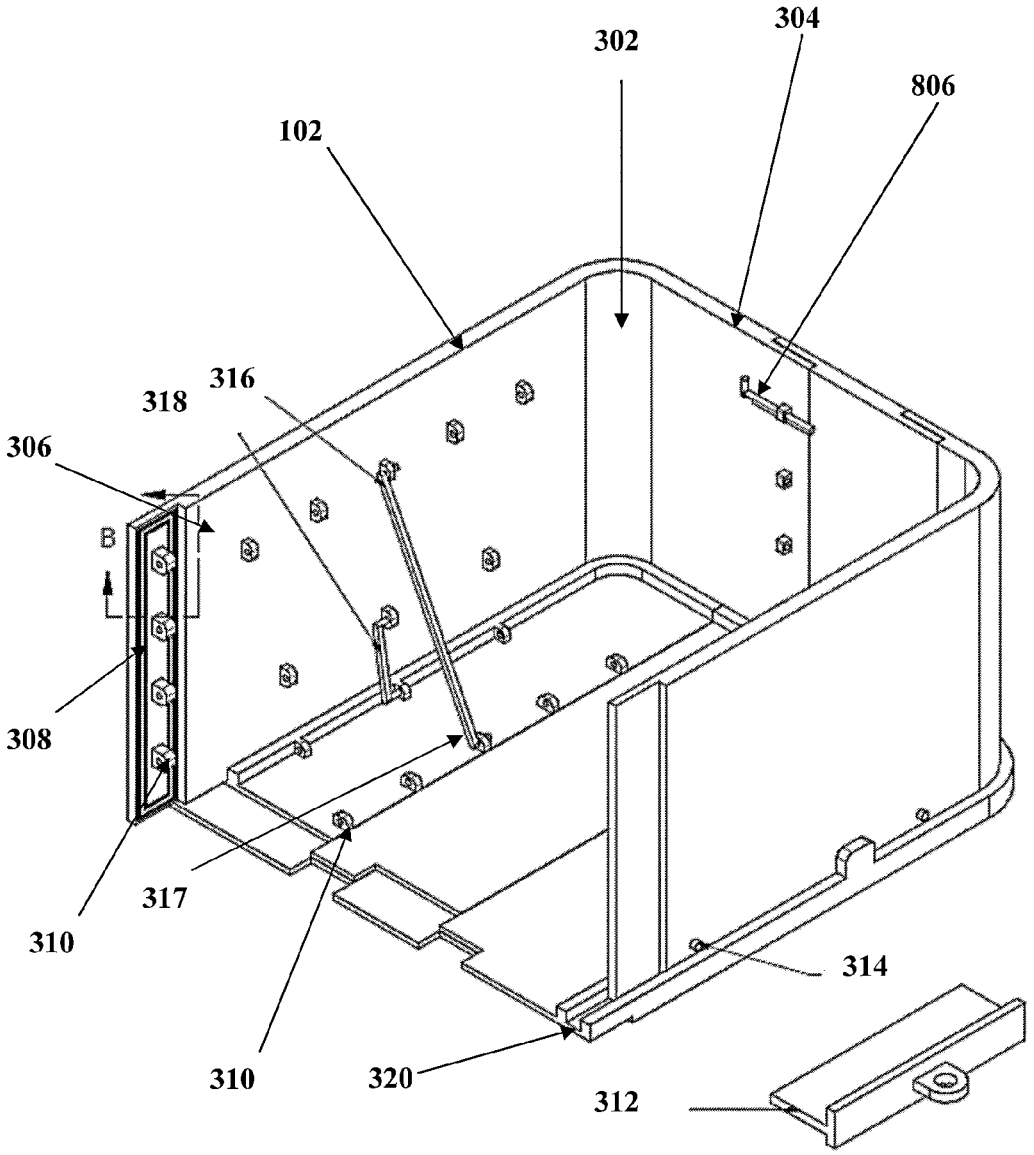
FIGS. 3-6 show various views of a proposed flexible fluid tank, according to an exemplary embodiment.

When the tank system is shaped as a parallelogram, the walls are thus comprised of two or more curved members (102, 104, 128, 132) as well as zero or more straight members (130, 134). This becomes clear when looking at FIGS. 2A-2B, where we see the base 106 of a smaller tank made up of two interlocking/overlapping floor panels 202, 204, and the walls of two side wrap around panels (206, 208).

Extracting the fluids from the tank is critical. Fluid entry/exit from the tank may be accomplished in one embodiment via the use of one or more wall openings (110, 112, and 114) supplied along the side of one or more of the panels. As seen in FIGS. 11-14, in one embodiment, a pipe is fitted to the opening 110, and a manifold 1202 is placed at the end. In an alternate embodiment, a pipe may run straight to the unit pulling liquid from the tank to the unit itself.

The ability of such a tank to remain leak less and structurally sound resides primarily in the design of the joints between the panels, as well as in their securing to both each other and (in the case of the side panels) to the base channel.

In one embodiment, the primary joint between the panels (whether side or floor) can be observed in FIGS. 3-10. In one embodiment, the side panel 102 has a curved portion 302 (although it may be straight or any other suitable shape), and joins at both ends 304, 306. In an alternate embodiment, a seal may be applied along all or parts of the joining 304.

Figure 8:
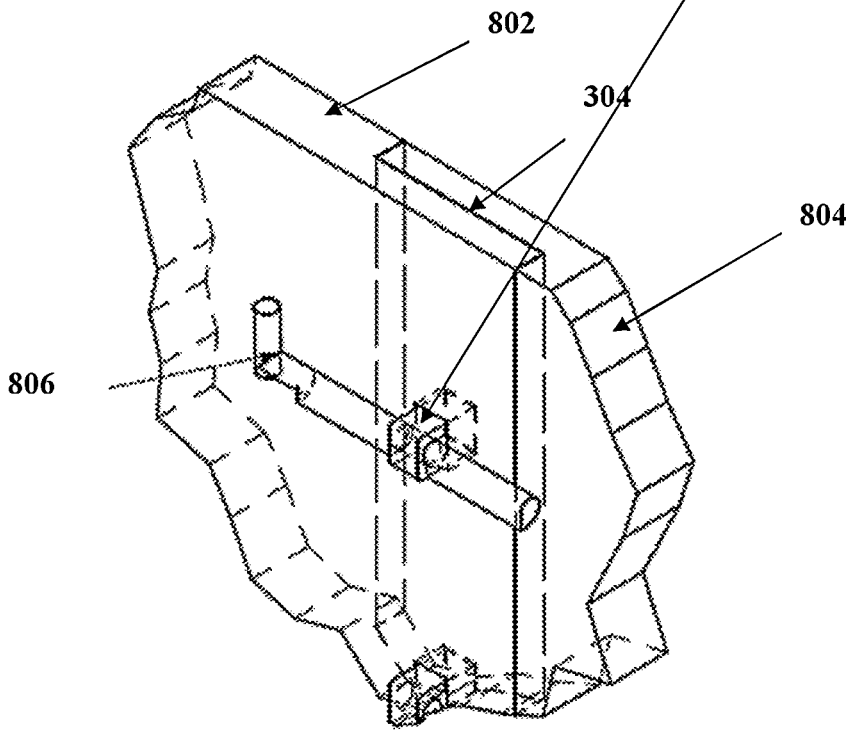
Figure 9:
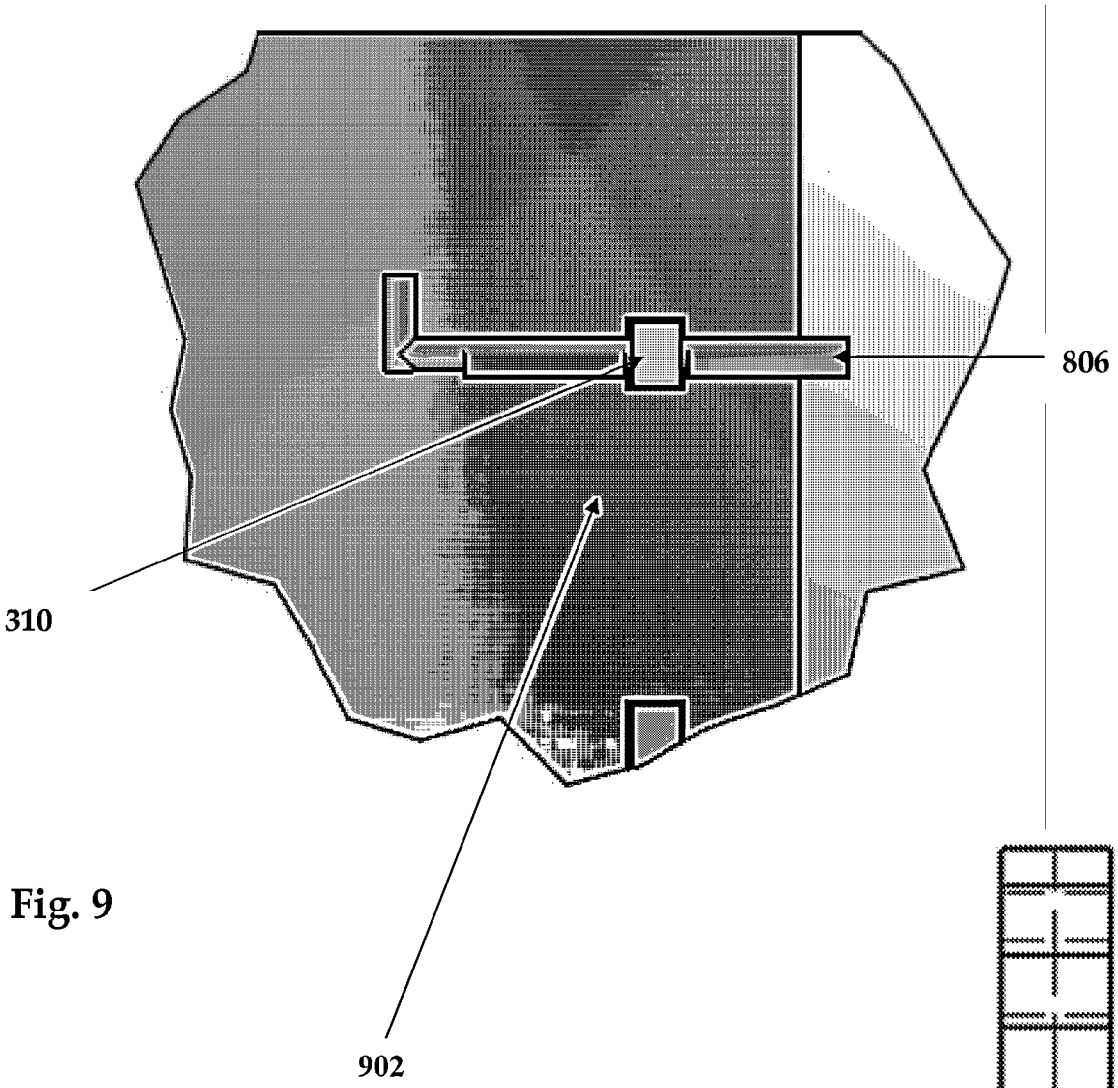
Figure 10:
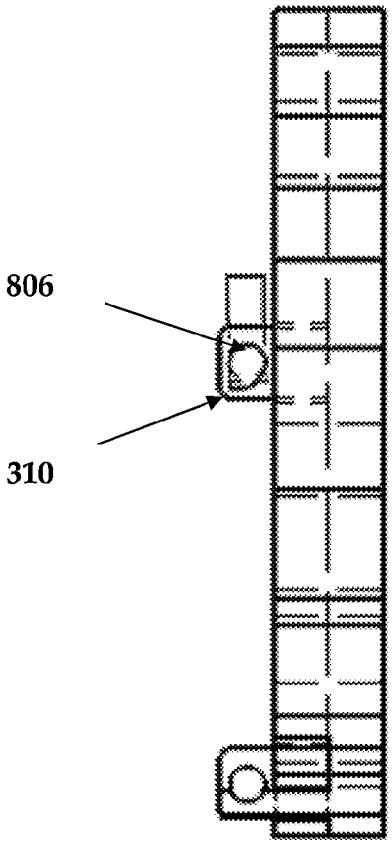
Figure 13:
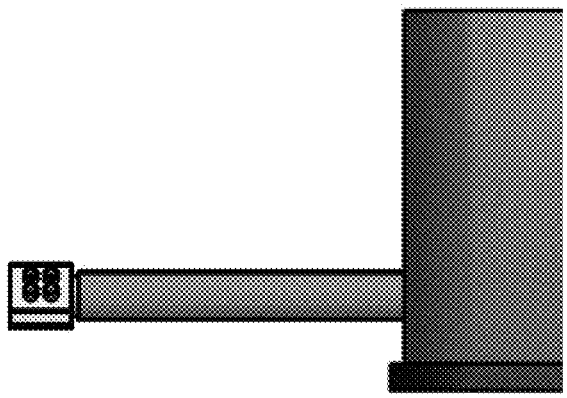
Figure 14:
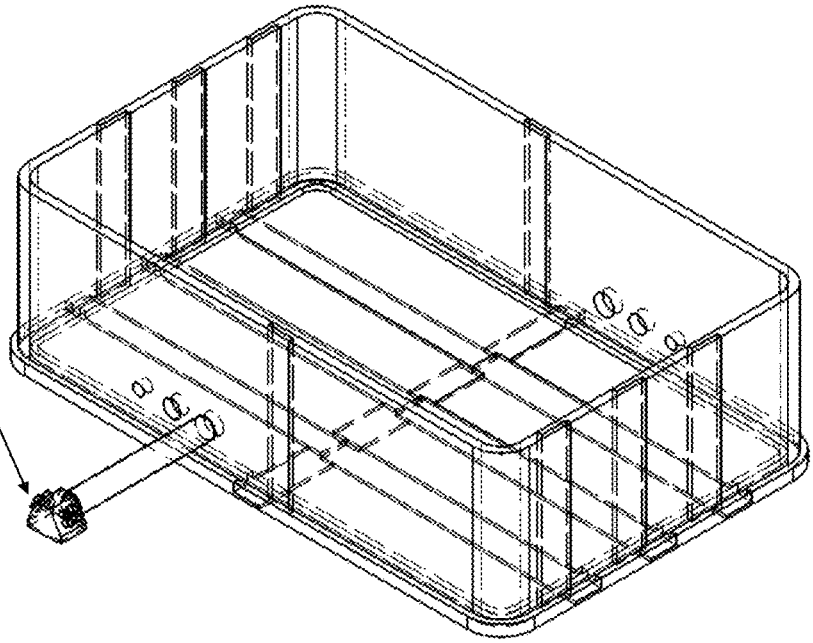
Figure 15:
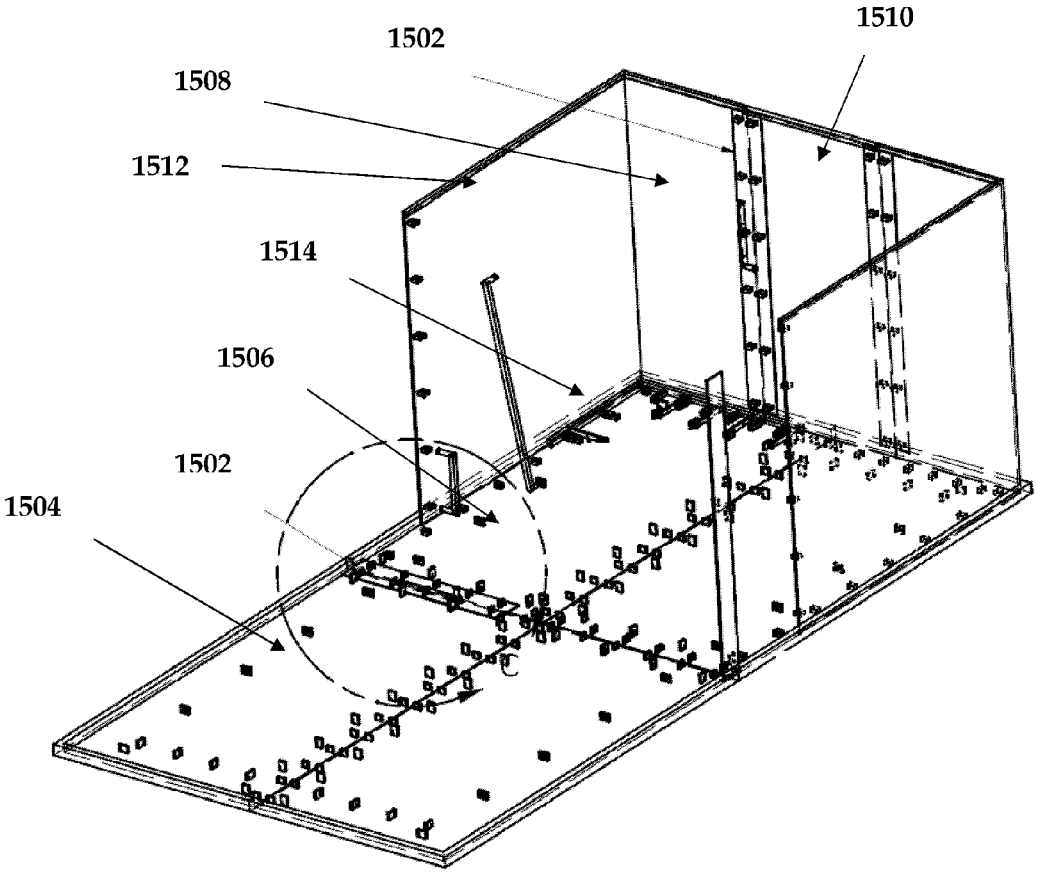
FIGS. 15-24 show various views a proposed square flexible fluid tank, according to an exemplary embodiment.
Figure 16:
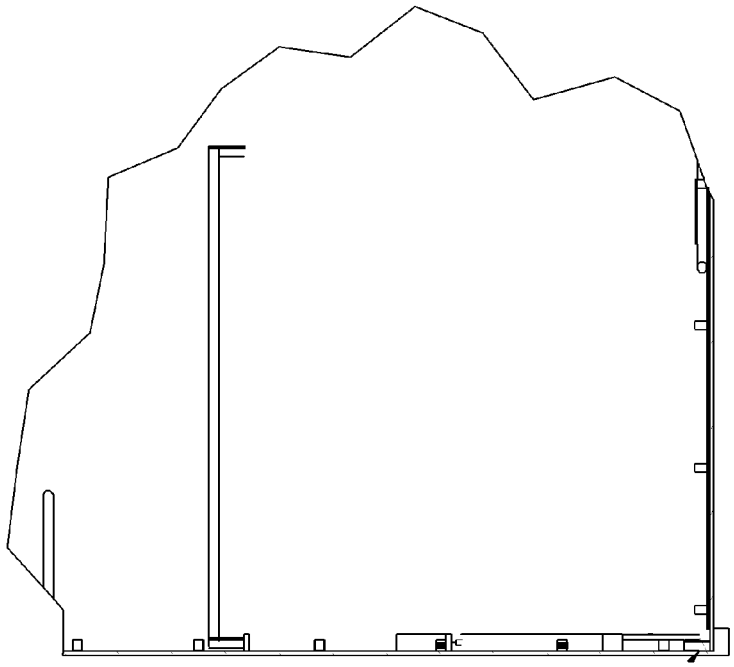
Figure 17:
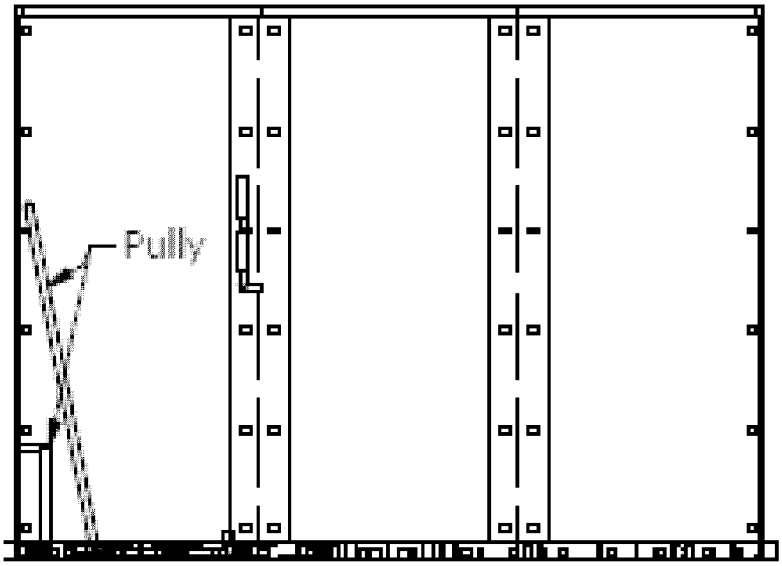
Figure 18:
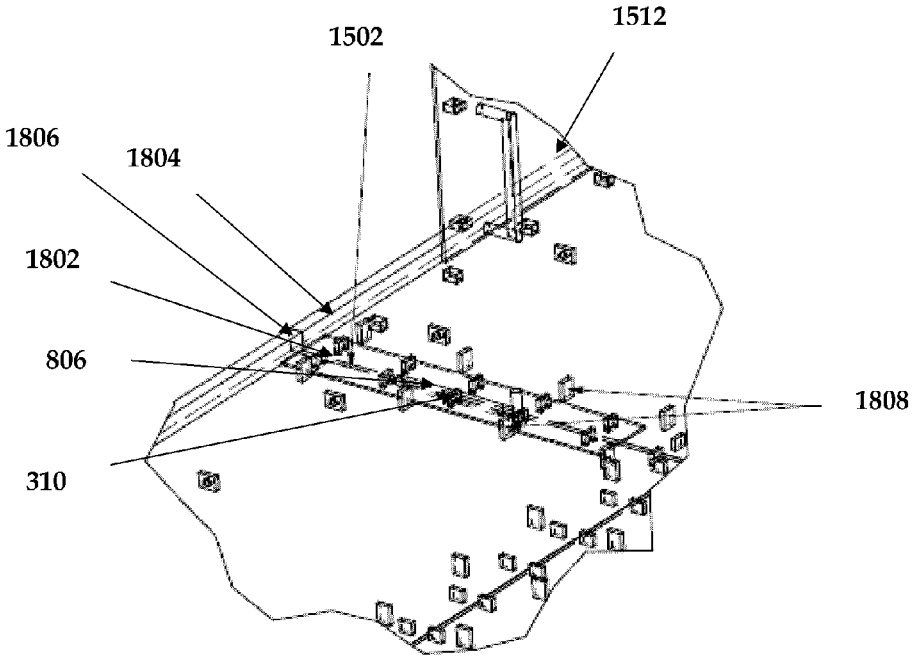
Figure 19:
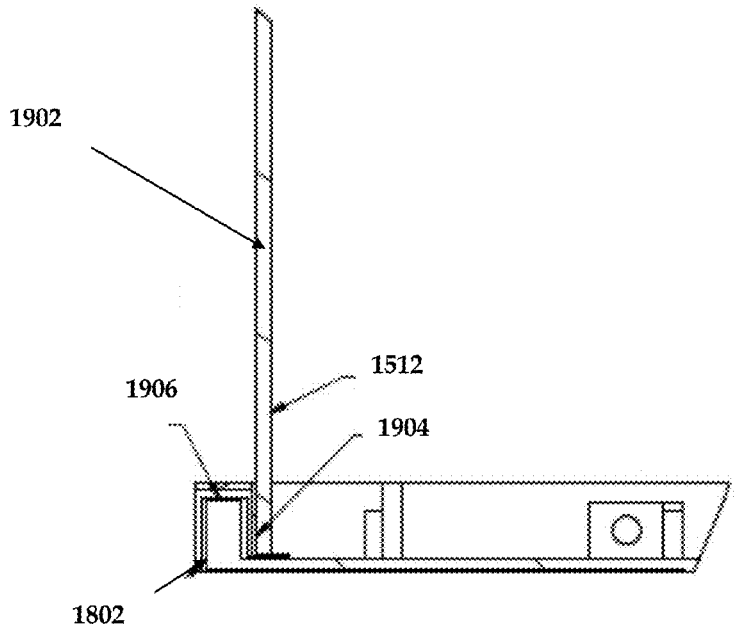
Figure 20:
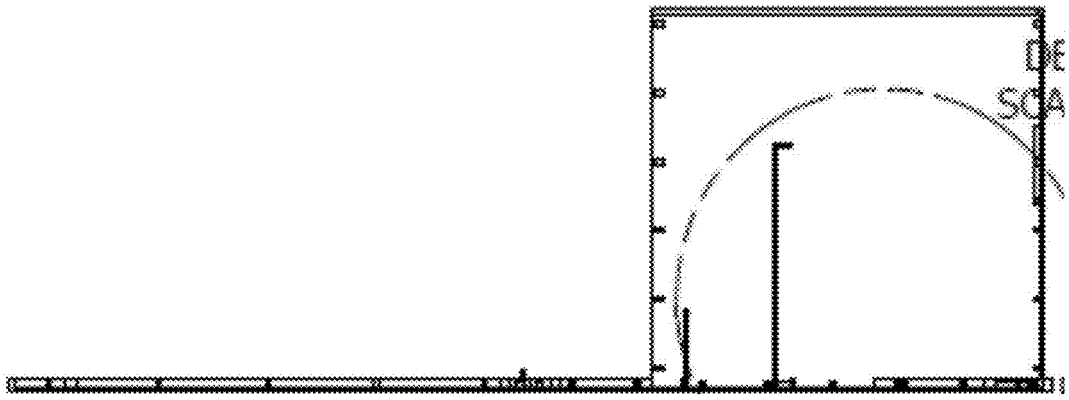
Figure 21:
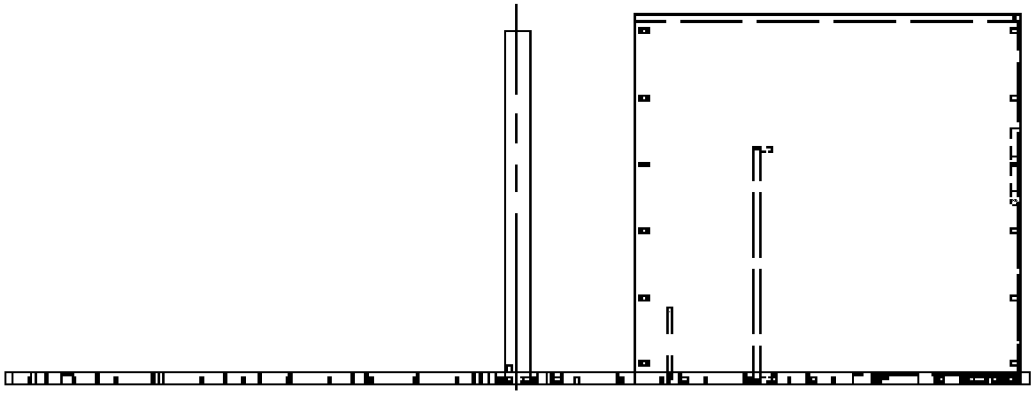
Figure 22:
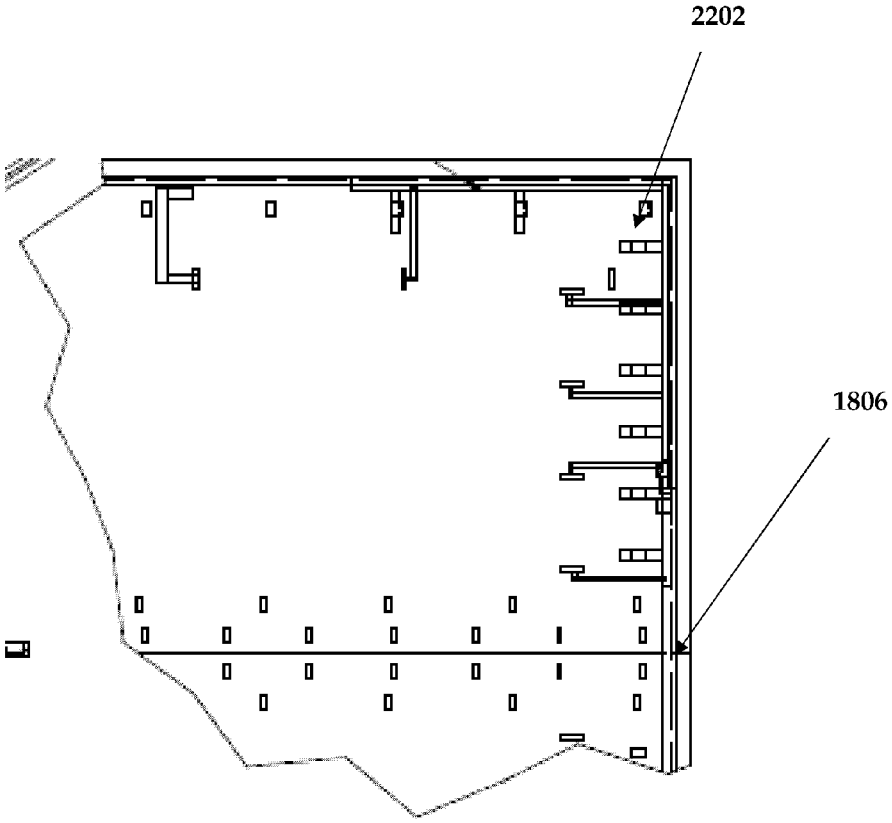
Figure 23:
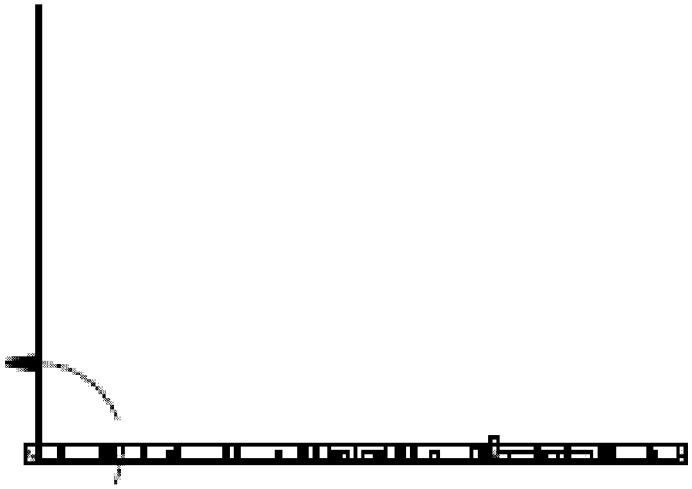
Figure 24:
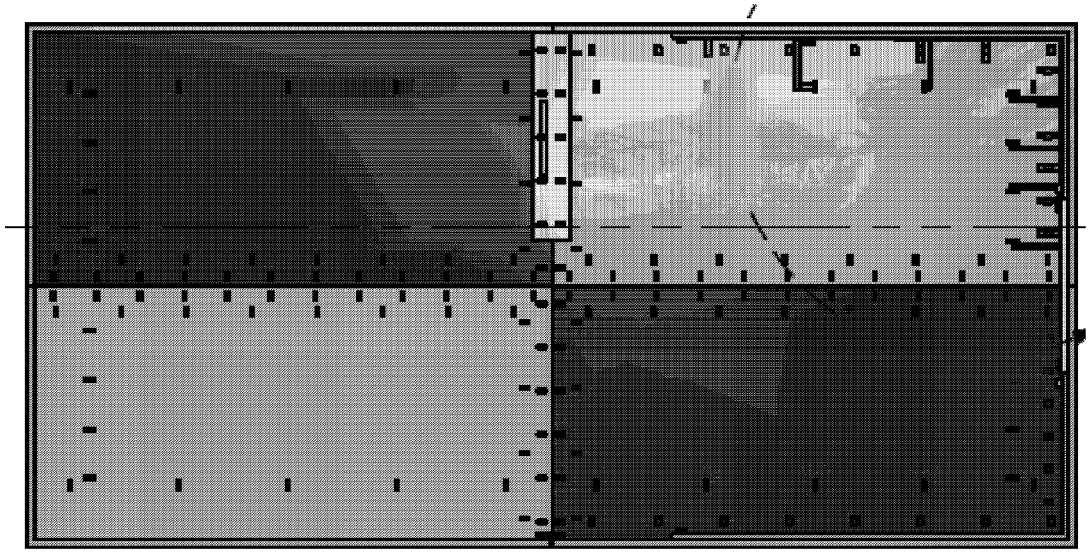
Figure 25:
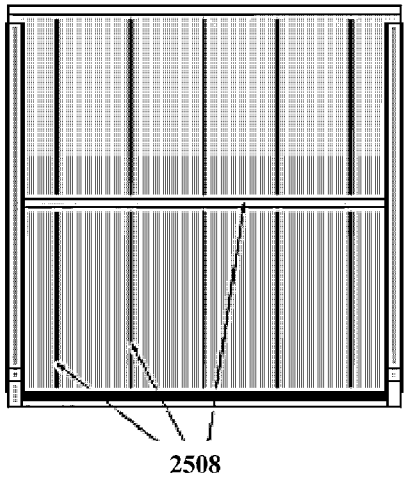
FIGS. 25-36 show various views of a composite proposed flexible fluid tank, according to an exemplary embodiment.
Figure 26:
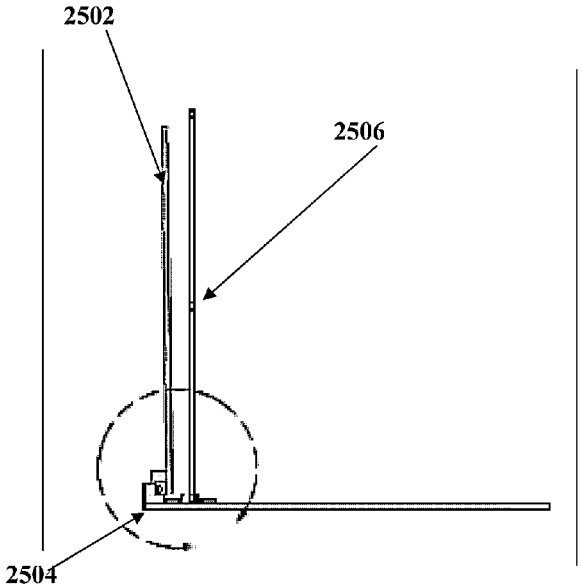
Figure 27:
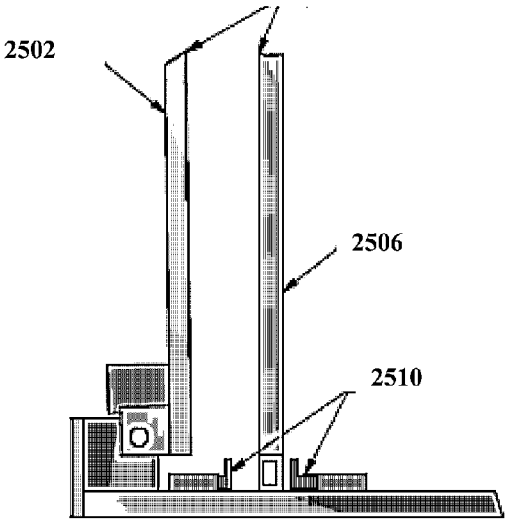
Figure 28:
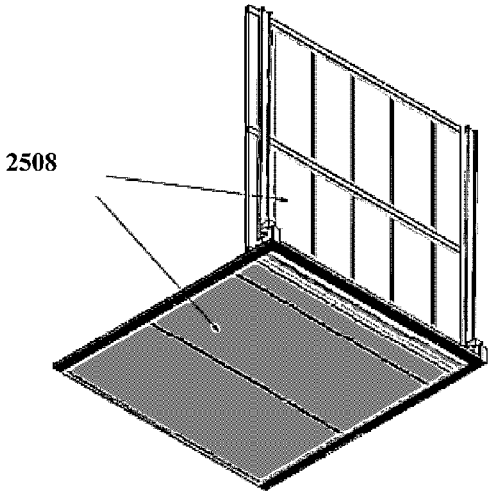
Figure 29:
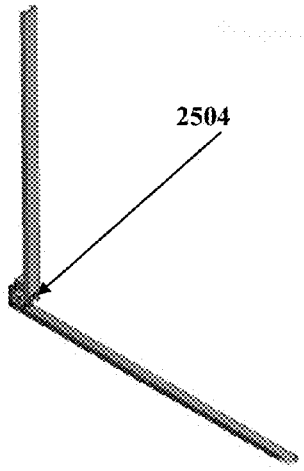
Figure 30:
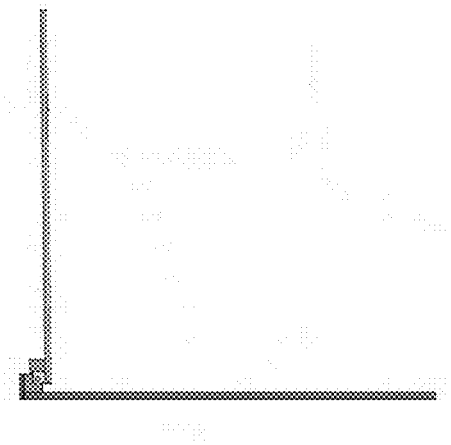
Figure 31:
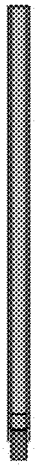
Figure 32:
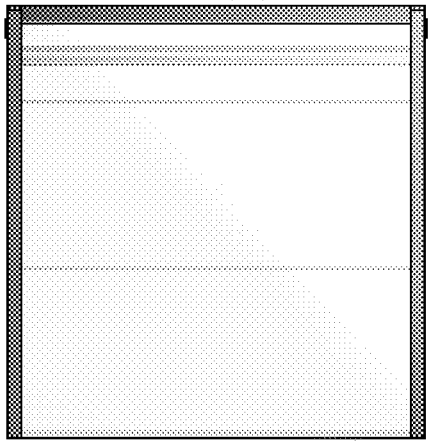
Figure 33:
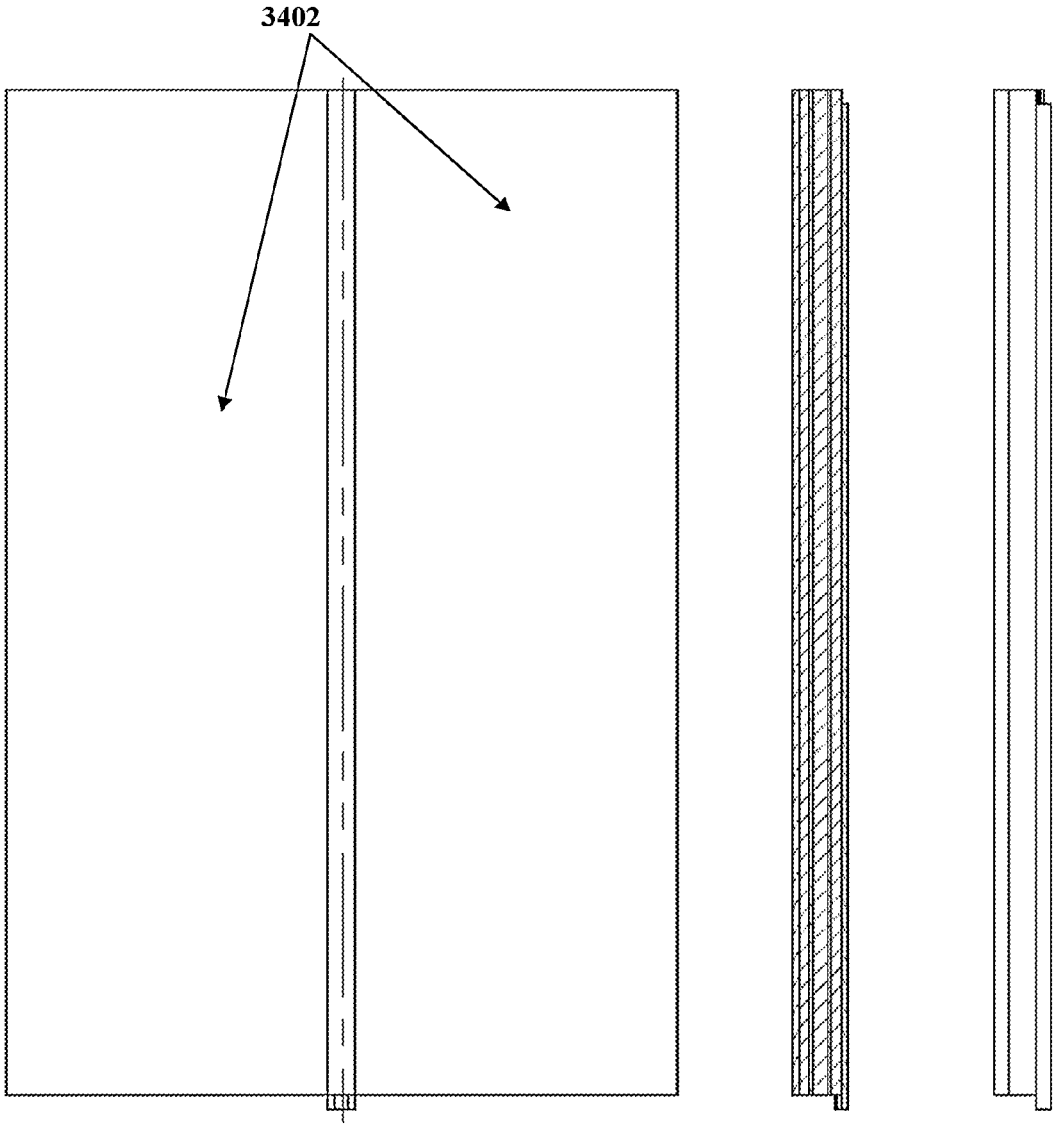
Figure 34:
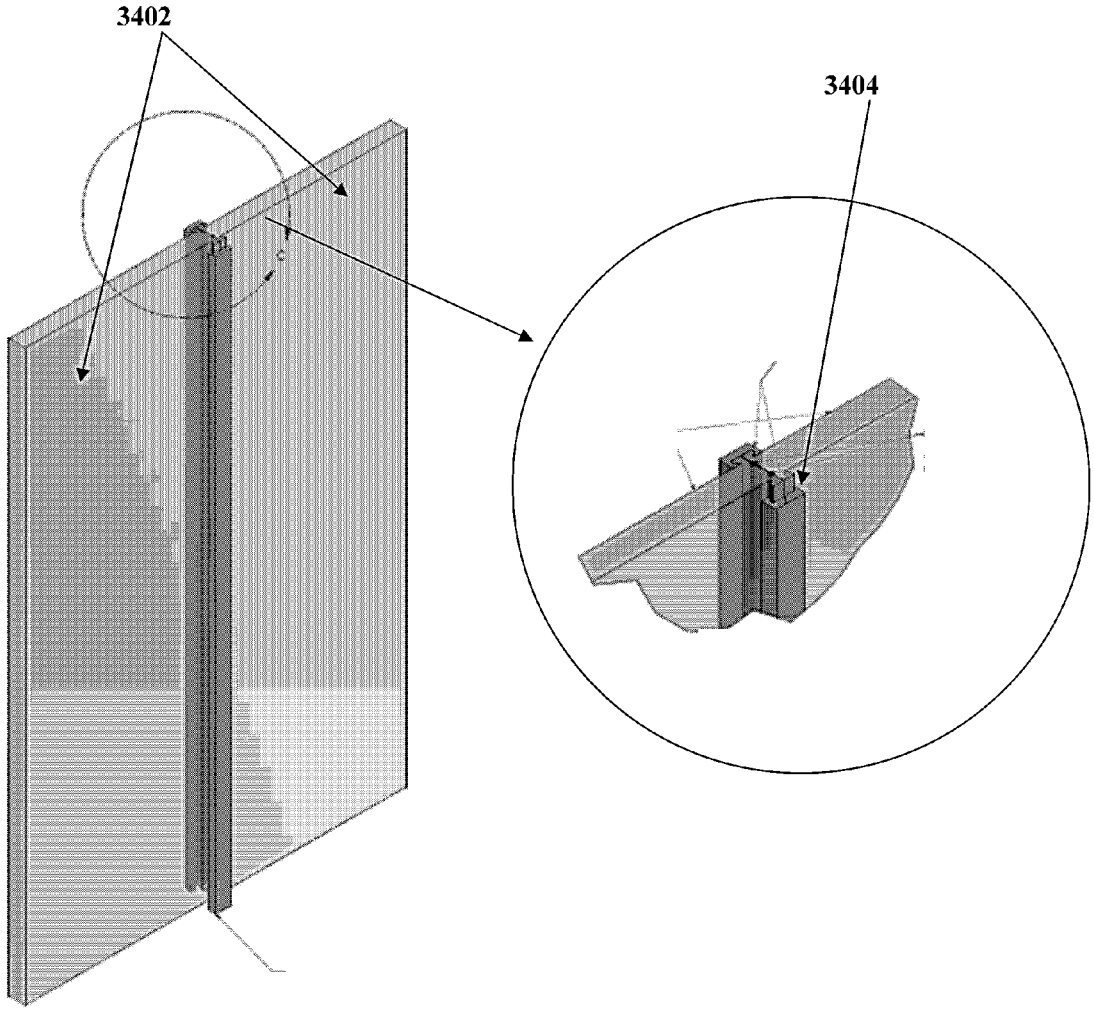
Figure 35:
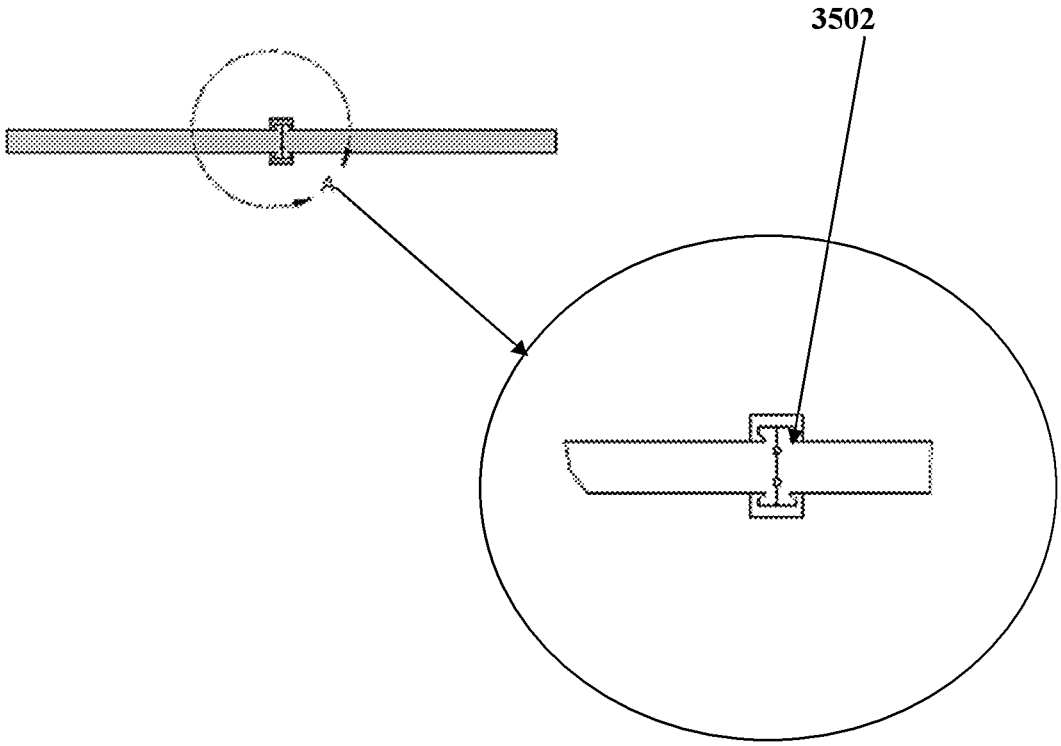
Figure 36:
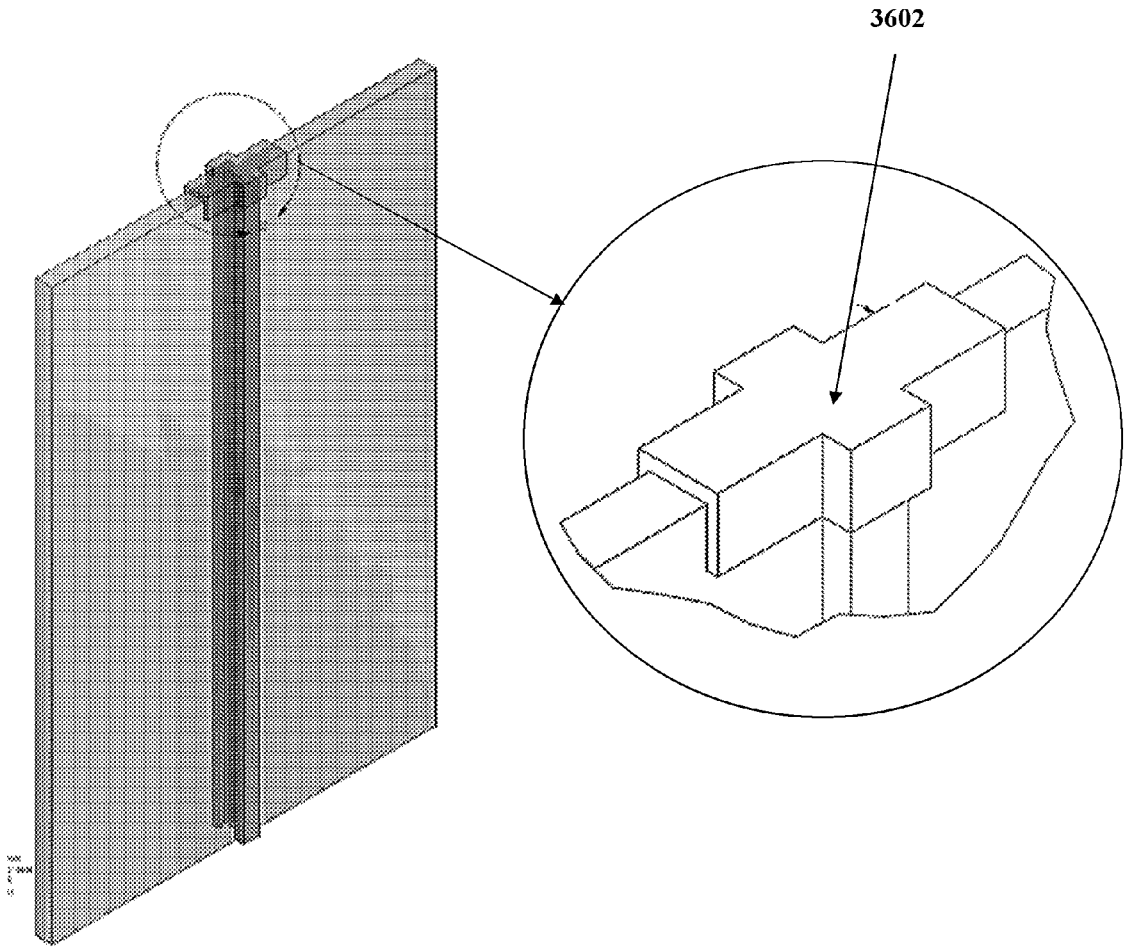
Figure 37:
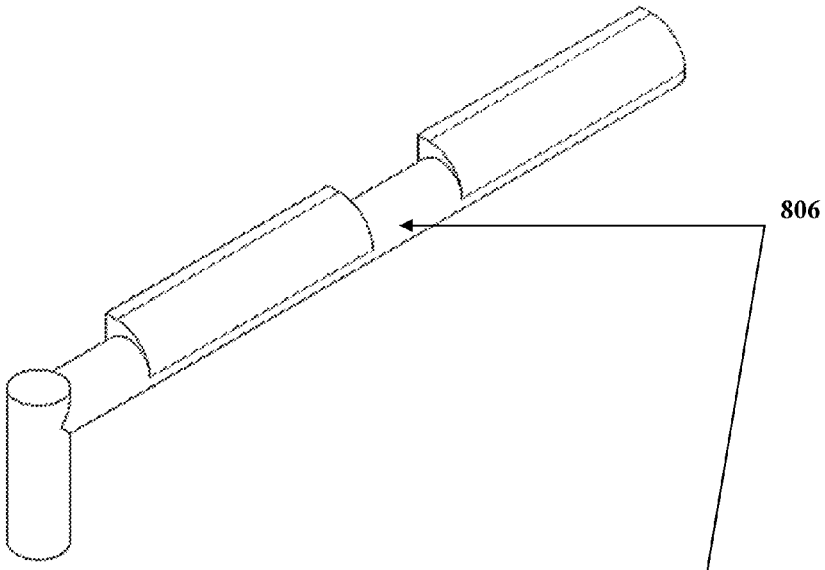
FIGS. 37-38 show various views of the pin, according to an exemplary embodiment.
Figure 38:
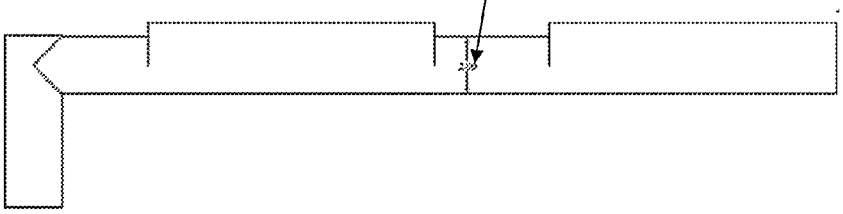
Figure 39:
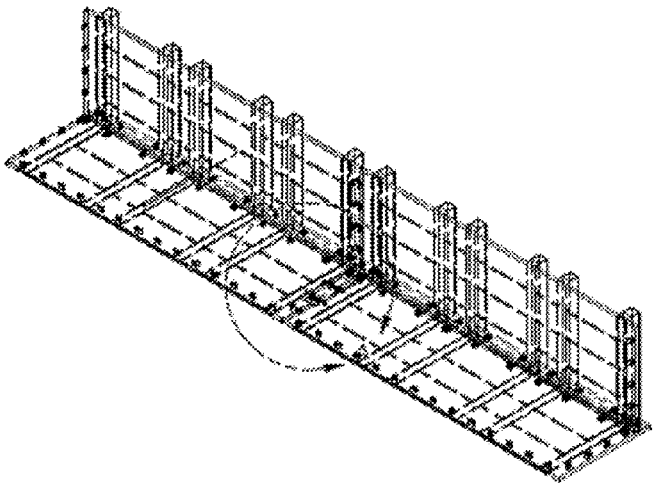
FIGS. 39-41 show various views of a large proposed flexible fluid tank, according to an exemplary embodiment.
Figure 40:
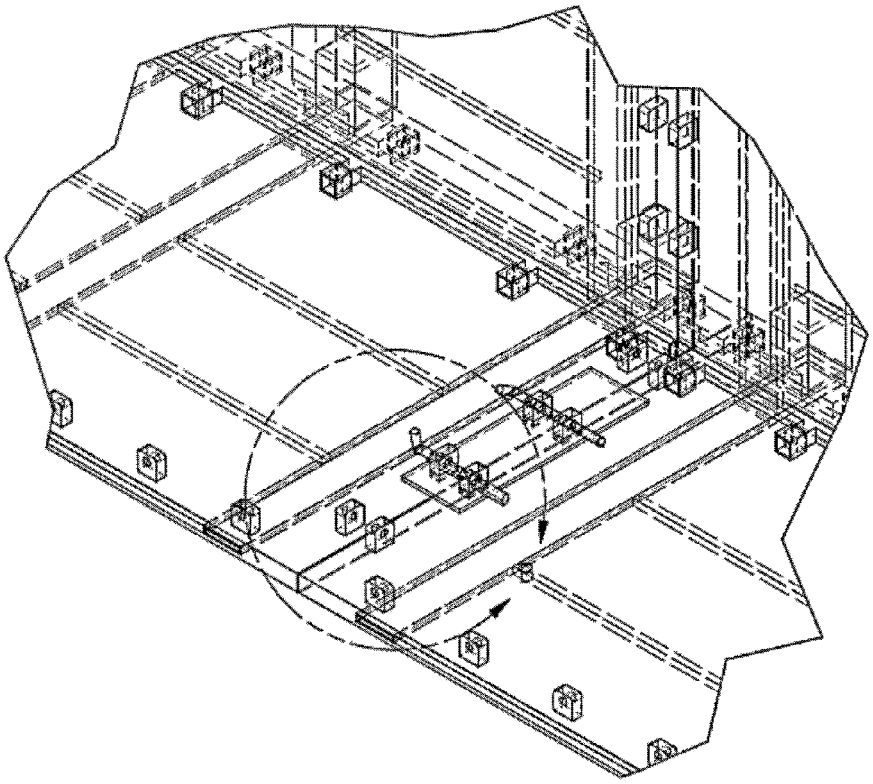
Figure 41:
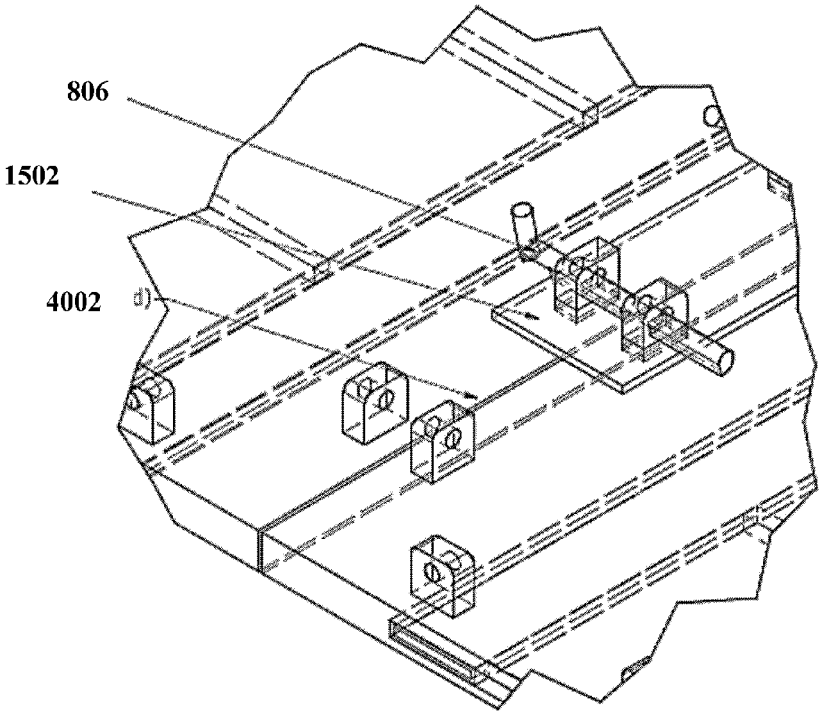

A gasket, O-ring, silicone weld, rhino liner or seal 308 runs around the area of the joint, with one or more loops 310 being located inside the joint, in order to seal the insides of the joint to a matching partial depth joint which has a matching number of openings designed to allow the loops to go through them and be secured with a pin 806. Referring to FIG. 8, we see the outside joint 304 in detail. Matching side 802 has the openings, so that when the side with the loops is placed against it, the loops 310 go through the openings. Sealing and mechanical securing is accomplished by the insertion and rotation of a pin 806.

The cross section shows one embodiment in which the shape of the pin 806 is elliptical within a circular opening in the loop 310. Thus, rotation of the pin allows pressure of the seal(s) to each other. Other implementations may include screws/nuts, and any other suitable mechanical pressure means. Additionally, welding of one or more of the pins, or securing via separate mechanical means (like a latch) may be used. In an alternate embodiment, the panels may be designed so that all the latches are on the outside or a combination. A design with all of them internally is preferred, for vandalism minimization reasons.

Note that while the gasket 308 is shown on the side with the loops, in alternate embodiments they may be located on either the joint side with the loops, the slits or both. Similarly, the sealing function of the gasket may be accomplished with a grooved facet, allowing the use of an O-ring arrangement. The gasket, seal or O-ring may also be manufactured from such polymers, silicone, natural or synthetic rubber, leather, etc. More information on proper O-ring materials and design can be found on the Parker O-Ring Handbook (ORD 5700) the contents of which are incorporated herein by reference.

Figure 4:
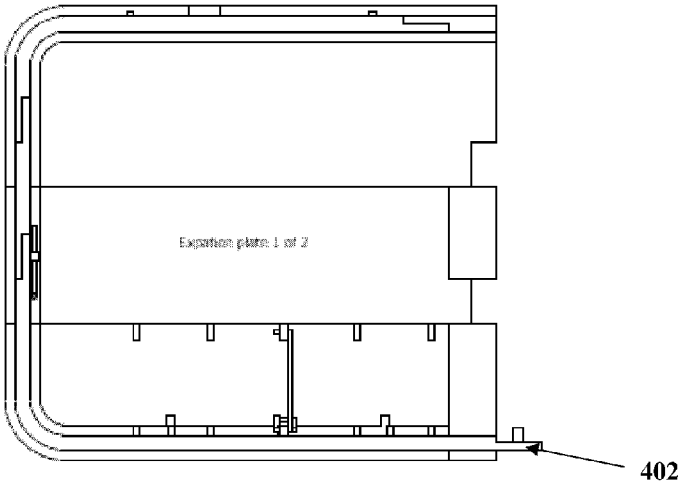
Figure 5:
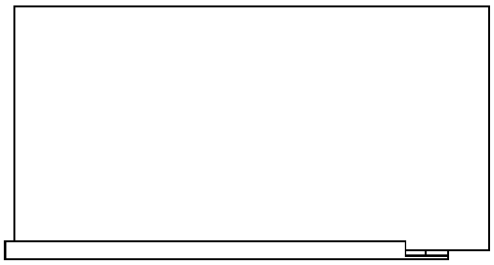
Figure 6:
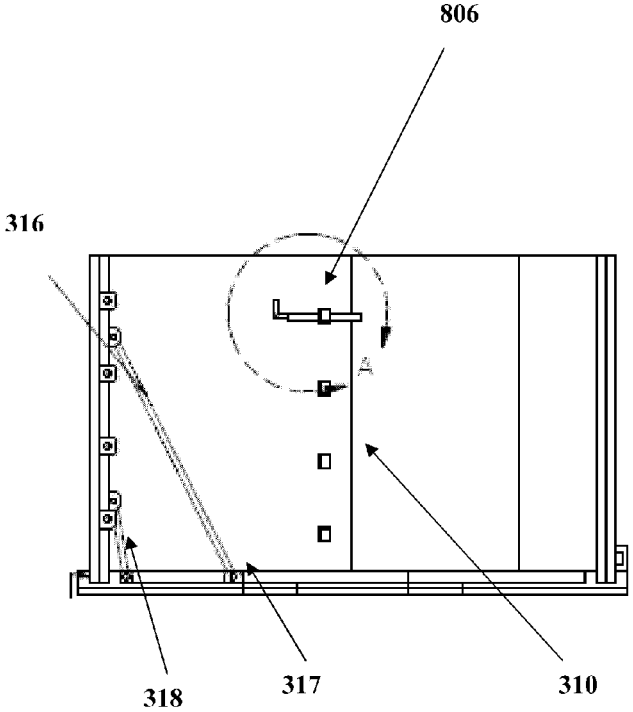
Figure 7:
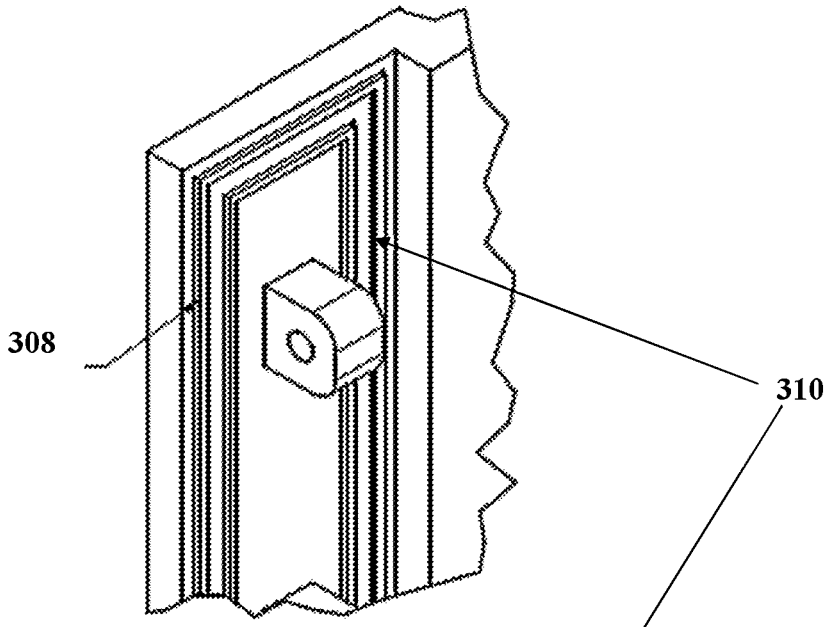
FIGS. 7-10 show various views of the pin and hook interface along the walls/floors of the proposed flexible fluid tank, according to an exemplary embodiment.

The floor panels 106 secure the same way, with pins within the loops 310 in the floor. Optional a pully 318 and pully arm (top 316 and bottom 317) may be used to connect to hooks 310 provide additional structural linkage strength between floor 120 and side 102 panels. The sealing means between the wall panels and the floor panels is accomplished in one embodiment via a groove or channel 320 within the base panels that may also be equipped with a similar seal, gasket or O-ring (to 308) to ensure the base-wall interface sealing means for the interface between the floor and wall. In another embodiment, we teach a similar arrangement groove 402 as seen in FIG. 4. Optional extra sealing may be applied around some of the corners, which may be accomplished by any caulking means familiar to those skilled in the art. Optional Jack lifts 314 and support plates 312 may be provided. The plates 312 may be inserted along portions of the channel 320 in order to have more support.

In an alternate embodiment, shown in FIGS. 15-24 and 39-41, a seal panel 1502 is used to strengthen the joining area between floor panels (1504, 1506) or wall panels (1508, 1510). Built in a similar fashion to the wall joints 308, this sealing panel 1502 has a complementary seal to that of the joint 308, minimizing or eliminating the leaking of the fluids within the structure, while providing structural integrity.

As with the floor matching, in one embodiment, the wall interlocking and sealing means and appropriate surface matching is accomplished through nubs or hoops 1802 that are attached to the outside panel/wall (1504, 1506, 1508, 1510) and go through the openings in the matched interface plate 1502 so that the sandwich of both acts as the sealing means that creates a seal between the floor (or wall) sections, so that when they are then pressed together through the insertion and rotation of a pin 806 on a loop 310 in one or more locations pressure is created against the sealing means within said panel sandwich loaves. Similar pressure may be accomplished by a nut/screw or other suitable mechanical linkage. In all cases, it is critical that these mechanical attachments (pin/nubs, nut/screw, etc.) be removable via simple mechanical action, preferably accomplished by a human with light or no tools.

In many cases, there is a risk that forces acting on the tank may cause one or more floor panels (or wall panels) to attempt to displace against each other, causing leaks. In one embodiment, a pintle, pulley, turnbuckle or other tension fitting 1808 may be used to provide forces to hold both the floor and side walls panels together against such leaks as well as holding them down. In one example related to the floor, at the joint where two floor plates meet 1806, a second seal 1906 is accomplished via a seal that doubles back or a gasket type seal vertically to ensure the sealing of the joint. Said second seal 1906 rests either above or below the primary seal 1904.

To reduce or eliminate such forces, a pintle, match, turnbuckle or similar mechanism may be used. The sealing plates or panels 1502 cover the entire floor joint, where a T-shaped seal 4002 is used in its entirety or portions thereof. They operate similarly when sealing the wall joints, be they between walls 1508, or between walls and extension plates 1510.

In another embodiment, the sealing means around the lower perimeter of the walls (where the walls 1508 meet the bottom plates 1506), may be accomplished in a twofold fashion. The bottom plate 1506 is built with a built in rim 1804, against which the wall's 1512 outside surface 1902 presses. A seal 1904 is laid along the bottom, sandwiched between the inside surface of the rim 1802 and the outside perimeter 1902 of the wall 1512.

In an alternate embodiment, an L-shaped seal is used, so that the seal will extend past the bottom of the wall, and be viewable by the installer, minimizing the chances of it being installed incorrectly. The sealing along the base is structurally finished by the addition of a sliding rail 1514 that is laid along the inner perimeter of the tank and presses the walls 1512 against the rim 1804 via the use of a turnbuckle, pushing rod, pushing screw, or some other pressing feature 2202.

Referring to FIGS. 25-32, we see an exemplary embodiment wherein the walls 2502 of the tank are made foldable through the addition of a hinge 2504 at the base, making it easier to transport and store. The hinge 2504 may be implemented as either a 90 degree or L hinge, or a completely foldable 180 deg. one, since in either case, the strength of the wall will be a combination of the hinge 2504 and of the walls interconnection as described above.

In an alternate embodiment, a second, internal liner composite surface 2506 is placed on the inside of the wall 2502 allowing for a composite sandwich 2508 of vertical and horizontal lines strengthening lines (be they made of plastic, carbon laminates of other composite form). The lower portions of the walls (2504, 2506) are held in place by one or more pressure fitting 2510.

Referring to FIGS. 33-36 we see an embodiment of the system that may be accomplished using panels made of various materials. These materials may be comprised of all or parts of metal (both ferrous and non-ferrous), wood (including composites such as particle board and compressed wood chips), Aerogel, Silica Aerogel, Aerographite, Glass, Synthetic fibers, Nanowire, Nanowires, nanotubes, Nanocellulose (including Nanocellulose Algae), Nanocellulose Aerogels, Grapheme, Grapheme Paper, Grapheme phoneme, Metallic Glass, Shrilk, Geofill Cellular Concrete, foam, polystyrene, fabricated expanded polystyrene, High Density polystyrene, Structural High Density EPS (polystyrene) and or expanded polystyrene.

In an alternate embodiment, the panels are manufactured as a composite core panel formed from a honeycomb panel formed with tubular cells at right angles to the panel where the panel is filled with reinforcing foam extending through the cells so as to provide an enhanced compression strength of the core in a direction longitudinally of the cells. The materials commonly used for the honeycomb panels are phenolic paper, aluminum and various types of plastic materials. The selection is made in part dependant on cost relative to the desired strength with the aluminum of course providing the highest strength at the highest cost.

Phenolic paper is the simplest and cheapest option and is very widely used. The honeycomb, in many cases, is formed by bonding strips side by side with the tubular cells formed around rods or simply by stretching the bonded strips longitudinally of the panel to open them up. Adhesive and heat sealing can be used for attaching the strips.

The panels 3402 may be linked together with a rail-style clamp 3404 that locks them together. In one embodiment FIG. 35, an optional seal may be fitted within a groove 3502 if required. These clamps may be pushed together FIG. 36 with a press fit 3602. As an additional measure, the panels may be capped by a connector clip or cover.

Figure 42:
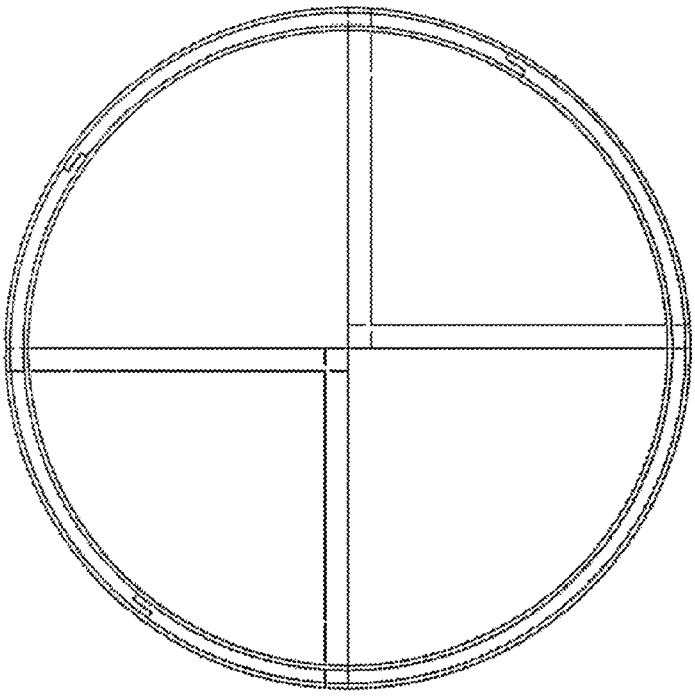
FIGS. 42-44 show various views of a round proposed flexible fluid tank, according to an exemplary embodiment.
Figure 43:
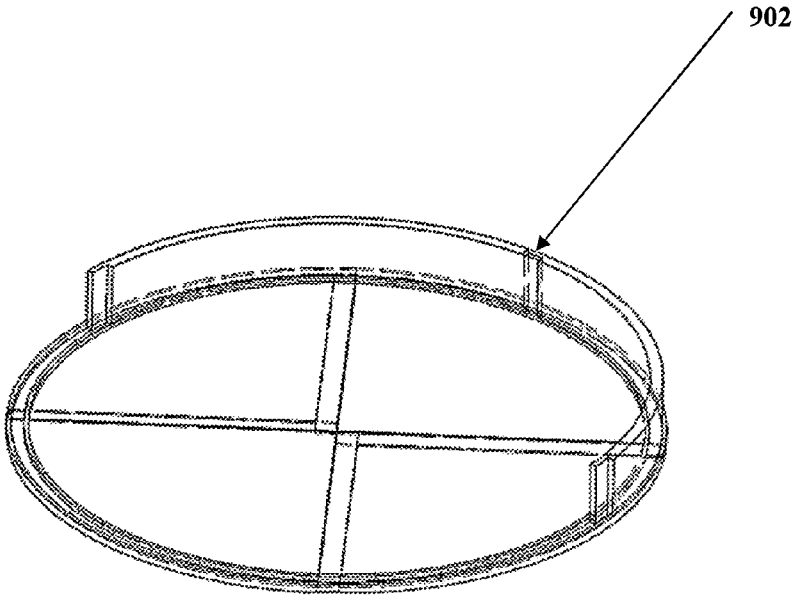
Figure 44:
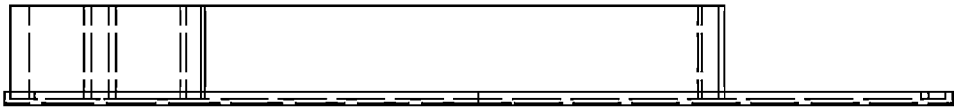
Figure 45:
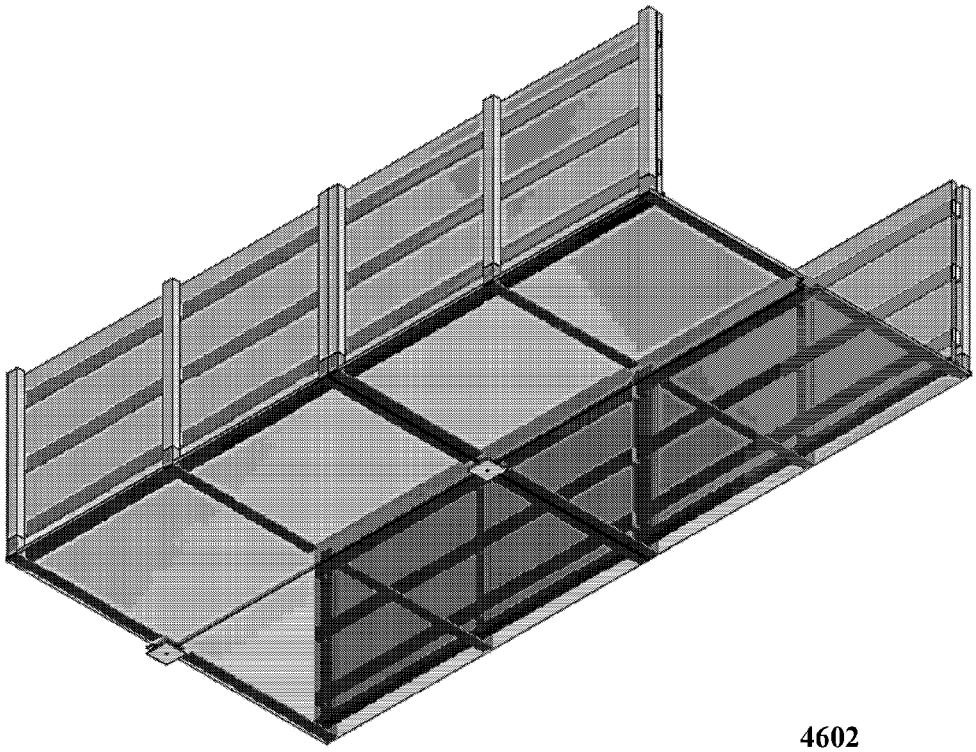
FIGS. 45-51 show various views of a rectangular proposed flexible fluid tank, according to an exemplary embodiment.
Figure 46:
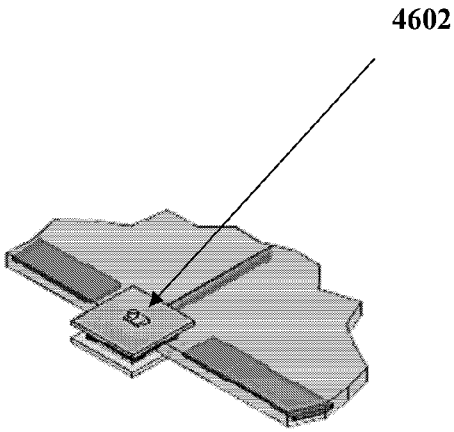
Figure 47:
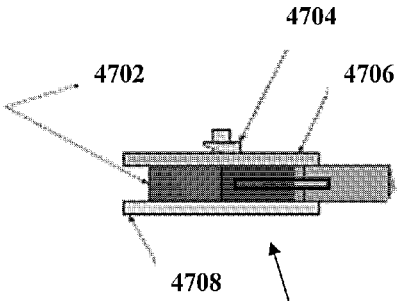
Figure 48:
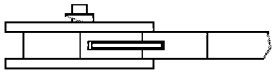
Figure 49:
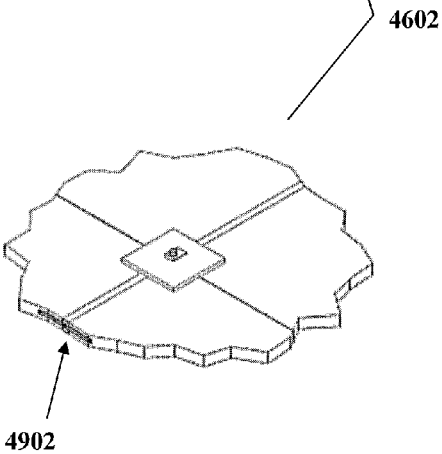
Figure 50:
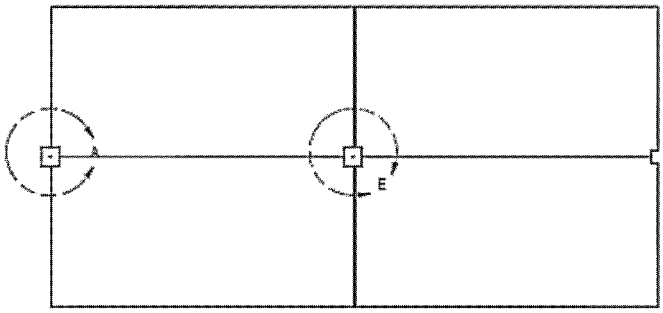
Figure 51:
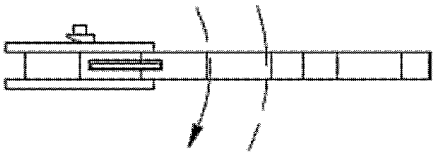
Figure 52:
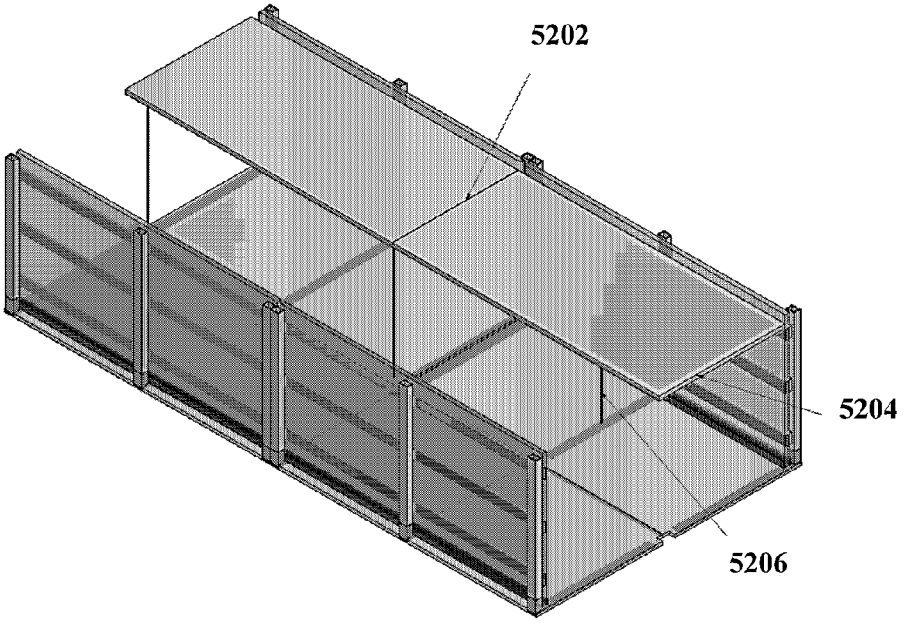
FIGS. 52-55 show various views of a proposed roof for a flexible fluid tank, according to an exemplary embodiment.
Figure 53:
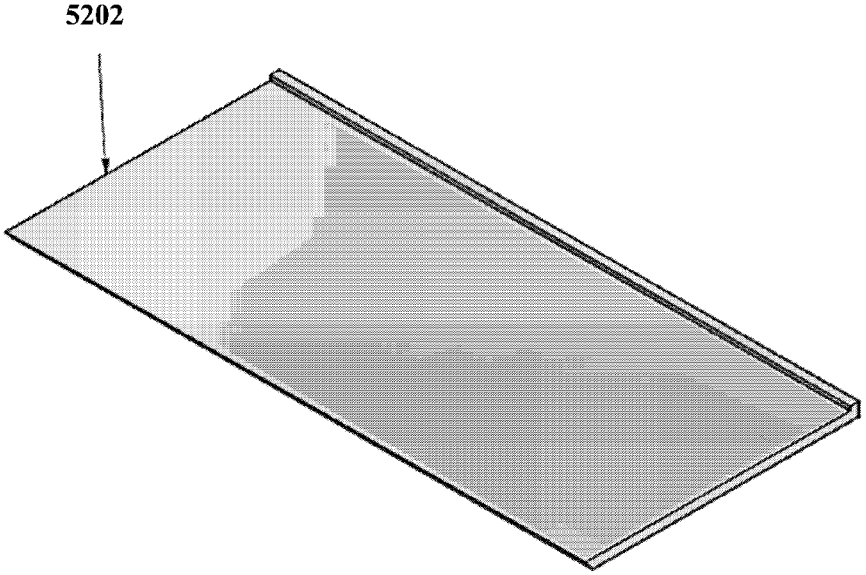
Figure 54:
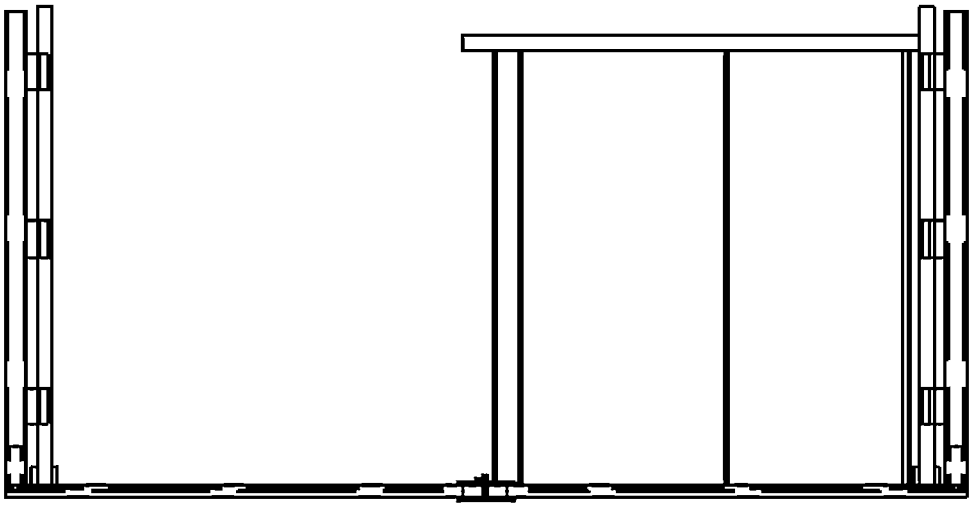
Figure 55:
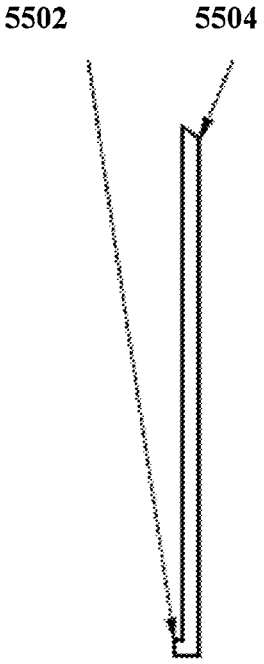

As seen in FIGS. 42-44, the unit may be circular shaped, In one embodiment, the walls are circular, with appropriate interlocking means 902 along the wall. In one embodiment, these interlocking means are pin 806 and hook 310 with or without a gasket or O-ring.

In another embodiment FIGS. 45-51, we see a flexible fluid tank embodiment where the base panels and their sealing means (be they O-ring or other seals) are joined or attached to those of other panels (in both X and Y direction, i.e. along the length and width of said base panels) through an seal interface joining mechanical pressure fitting 4602 that is capable of joining the seals or T-seals from two or more directions. Such a fitting 4602 may be in one embodiment square/rectangular, but any other suitable shape is possible, as long as its area overlaps those seals areas to be covered.

Such a mechanical pressure fitting 4602 is but one embodiment. In one embodiment, such a fitting 4602 is comprised of a compression seal 4702, a compression lever or nut 4704, an upper compression plate 4706 and a lower compression plate 4708. The edges may be embodied as an channel, or as a double seal FIGS. 25-32. In this fashion, the seal 4902 along the edge may be joined.

In one embodiment, referring to FIGS. 52-55 we see a proposed lid for the tank where top panels 5204 are used. These panels act like lily pads, floating on the liquid surface inside. In one embodiment, said panels 5204 are anchored 5206 to the floor of the tank via ropes, chains or any other suitable anchoring method, thus allowing it to move up/down while floating on top of the liquid, raising or lowering with the level of the liquid in the tank. The spacing 5202 between the pads may be made variable from zero tolerance to tight fit to gaps. Such spacing would allow the 'lily pad' design allows a human operator to fall in the tank, yet be able to swim to safety.

In one embodiment, we have a 100'×100' area to fill with lily pads covers that are 10'×10', so that you will cover the tank's area with 100 of them, anchored to cover the top with floating panels. These panels will be anchored to the tank strategically to allow the panel to adjust with the level and break away from the other 10'×10 panels to allow if anyone fell in to swim to safety or climb on one of the 10'×10' panels. In addition, the lid will act as insulation for the tank.

The panels themselves 5204 may be actively or passively solar equipped in order to heat the tank, or have all or portions of it be transparent so that operators may judge the condition of the fluid inside. Different edges 5502, 5504 may be used so that panels best realign and deflect with any winds.

Conclusion

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

I claim:

1. A liquid storage tank apparatus comprising;

a tank base comprised of two or more floor panels, each said panel having one or more floor panels interlocking with waterproof sealing means, and a rim protruding upwards along portions of said floor panels forming an external perimeter of said liquid storage tank apparatus;

tank walls comprised of two or more tank wall panels, each said tank wall panel having one or more matching sets of wall interlocking and waterproof sealing means along the wall panel side and bottom joints, wherein at least one said wall panel has one or more wall openings; and base-wall interface waterproof sealing means at or near the periphery of said tank base.

2. The tank apparatus of claim 1 wherein;

said floor or wall interlocking and waterproof sealing means are comprised of one or more waterproof seal interface mechanical pressure fittings located along said floor panels or said tank wall panels joints.

3. The tank apparatus of claim 2 wherein;

one or more of said floor panel or wall panel interlocking means are comprised of one or more pin and hooks arrangements.

4. The tank apparatus of claim 3, wherein;

said pins are tear shaped.

5. The tank apparatus of claim 4, wherein;

one or more said floor or wall waterproof seal interface mechanical pressure fittings include at least one element selected from the group comprised by a gasket, O-ring, silicon weld, rhino-liner or other suitable seal; and said base-wall interface waterproof seal interface mechanical pressure fittings include at least one element selected from the group comprised of a continuous base channel or one or more gaskets around its inner perimeter where said base interfaces with said wall's base.

6. The apparatus of claim 5, wherein;

one or more top panels are floated atop the liquid in said tank.

7. A method of making a liquid storage tank apparatus comprising;

providing a tank base comprised of two or more floor panels, each said panel having one or more floor panels interlocking with waterproof sealing means, and a rim protruding upwards along portions of said floor panels forming an external perimeter of said liquid storage tank apparatus;

providing tank walls comprised of two or more tank wall panels, each said tank wall panel having one or more matching sets of wall interlocking and waterproof sealing means along the wall panel side and bottom joints, wherein at least one said wall panel has one or more wall openings; and providing base-wall interface waterproof sealing means at or near the periphery of said tank base.

8. The method claim 7 further wherein;

said floor or wall interlocking and waterproof sealing means are comprised of one or more waterproof seal interface mechanical pressure fittings located along said floor panels or said tank wall panels joints.

9. The method of claim 8 further wherein;

one or more of said floor panel or wall panel interlocking means are comprised of one or more pin and hooks arrangements.

10. The method of claim 9, further wherein;

said pins are tear shaped.

11. The method of claim 10, further wherein;

one or more said floor or wall waterproof seal interface mechanical pressure fittings include at least one element selected from the group comprised by a gasket, O-ring, silicon weld, rhino-liner or other suitable seal; and said base-wall interface waterproof seal interface mechanical pressure fittings include at least one element selected from the group comprised of a continuous base channel or one or more gaskets around its inner perimeter where said base interfaces with said wall's base.

12. The method of claim 11, further comprising;

providing one or more top panels are floated atop the liquid in said tank.

* * * * *